US006002385A

United States Patent [19]

Silverbrook

[11] Patent Number: 6,002,385

[45] **Date of Patent: *Dec. 14, 1999**

[54] COMPUTER DISPLAY SYSTEM CONTROLLER

[75] Inventor: Kia Silverbrook, Leichhardt, Australia

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/402,497

[22] Filed: Mar. 13, 1995

[30] Foreign Application Priority Data

| | | | |
|---|---|---|---|
| Mar. 11, 1994 | [AU] | Australia | PM4401 |
| Mar. 11, 1994 | [AU] | Australia | PM4405 |
| Mar. 11, 1994 | [AU] | Australia | PM4406 |
| Mar. 11, 1994 | [AU] | Australia | PM4410 |
| Mar. 11, 1994 | [AU] | Australia | PM4411 |
| Mar. 11, 1994 | [AU] | Australia | PM4414 |
| Mar. 11, 1994 | [AU] | Australia | PM4415 |

[51] Int. Cl.[6] ..... G09G 3/36

[52] U.S. Cl. ..... 345/100

[58] Field of Search ..... 345/89, 147, 152, 345/204, 100

[56] References Cited

U.S. PATENT DOCUMENTS

| | | | |
|---|---|---|---|
| 4,763,120 | 8/1988 | Morrish et al. | 345/152 |
| 4,859,997 | 8/1989 | Bouron et al. | 340/752 |
| 5,298,915 | 3/1994 | Bassetti, Jr. | 345/152 |
| 5,353,041 | 10/1994 | Miyamoto et al. | 345/100 |
| 5,491,496 | 2/1996 | Tomiyasu | 345/89 |
| 5,499,037 | 3/1996 | Nakagawa et al. | 345/89 |
| 5,663,745 | 9/1997 | Ishikawa et al. | 345/100 |
| 5,696,524 | 12/1997 | Hoshino et al. | 345/100 |

FOREIGN PATENT DOCUMENTS

| | | | |
|---|---|---|---|
| 0174809 | 3/1986 | European Pat. Off. | G09G 1/16 |
| 0250868 | 1/1988 | European Pat. Off. | G09G 1/16 |
| 0274942 | 7/1988 | European Pat. Off. | G09G 3/20 |
| 0361981 | 4/1990 | European Pat. Off. | G02F 1/133 |
| 0526135 | 2/1993 | European Pat. Off. | G02F 1/1343 |
| 0558342 | 9/1993 | European Pat. Off. | G09G 3/36 |
| 0573822 | 12/1993 | European Pat. Off. | G09G 3/36 |
| 0579359 | 1/1994 | European Pat. Off. | G09G 3/36 |

*Primary Examiner*—Amare Mengistu

*Attorney, Agent, or Firm*—Fitzpatrick, Cella, Harper & Scinto

[57] ABSTRACT

There is disclosed a system (45, 55) for controlling a high resolution color discrete level display device, wherein the display device can have multiple common lines (80, 81, 82) for each line of pixels. A frame buffer controller system (45) is disclosed which is adapted to utilise the multiple common lines in a number of different modes, producing a number of different output speeds for the display. Means (126, 127) are also disclosed for dithering the pixel data in accordance with the output modes. Further, the system is capable of displaying images, such as fonts or the like, at an increased resolution than that which would otherwise be possible.

49 Claims, 21 Drawing Sheets

Ideal character (Times Roman "A")

COMPUTER DISPLAY SYSTEM CONTROLLER

FIELD OF THE INVENTION

The present invention relates to the display of images on a display apparatus such as a colour computer display or a video display and, more specifically, the display of images on a display apparatus such as a ferroelectric liquid crystal display which is a discrete level display having a memory capability.

BACKGROUND OF THE INVENTION

In recent years, computer workstations, comprising a computational device, input devices and display devices, have become increasingly popular. In addition the demand for high powered workstations with high quality, high resolution displays has also increased dramatically.

Normally these demands are partially satisfied through the provision of Cathode Ray Tube (CRT) type devices capable of high resolution display. However, such devices tend to be extremely bulks, have an excessive weight and consume large amounts of power.

Recently, it has beer, proposed to provide a high resolution discrete level display having a large number of pixels with the pixels arranged in lines, and with each pixel having a plurality of independently setable areas with the overall pixel able to display a predetermined number of different discrete levels. The independently settable areas being controlled by a series of intersecting drive and common lines, are designed to cam predetermined voltages to each pixel of the display. Examples of these types of displays include liquid crystal displays, plasma displays and electroluminescent displays.

SUMMARY OF THE INVENTION

It is an object of the present invention to provide a display driver system, suitable for use with a discrete level display having a pixel arrangement as hereinbefore described.

In accordance with a first aspect of the present invention there is provided a computer work station comprising:

a computation and data manipulation unit including means for the creation and manipulation of images, said computation and data manipulation unit being connected to a frame buffering means and being adapted to store images in said frame buffering means;

said frame buffering means comprising a frame buffer storage means for the storage of images and a frame buffer controller means connected to said computation and data manipulation unit and also connected to a high resolution discrete level display device; and said high resolution discrete level display device including a plurality of pixels, which are arranged in an array of substantially parallel lines, with each pixel in a line having a plurality of common drive lines;

wherein images created or manipulated by said computation and data manipulation unit which are to be displayed on said high resolution discrete level display device are stored in said frame buffer and subsequently displayed on said high resolution display device.

BRIEF DESCRIPTION OF THE DRAWINGS

The preferred embodiment of the present invention will now be described with reference to the accompanying drawings in which:

FIG. 24 is a side-on view of the computer workstation display of FIG. 23; and.

Referring now to FIG. 1, there is shown the preferred embodiment 1 of the computer workstation. This includes a base computer system 2 which is organised around a central high speed bus 3. This high speed bus has connected via a high speed cache 4, a high speed microprocessor such as an Intel Pentium, Mips R4000, DEC Alpha (Registered Trade Marks) or the like.

Figure 1:
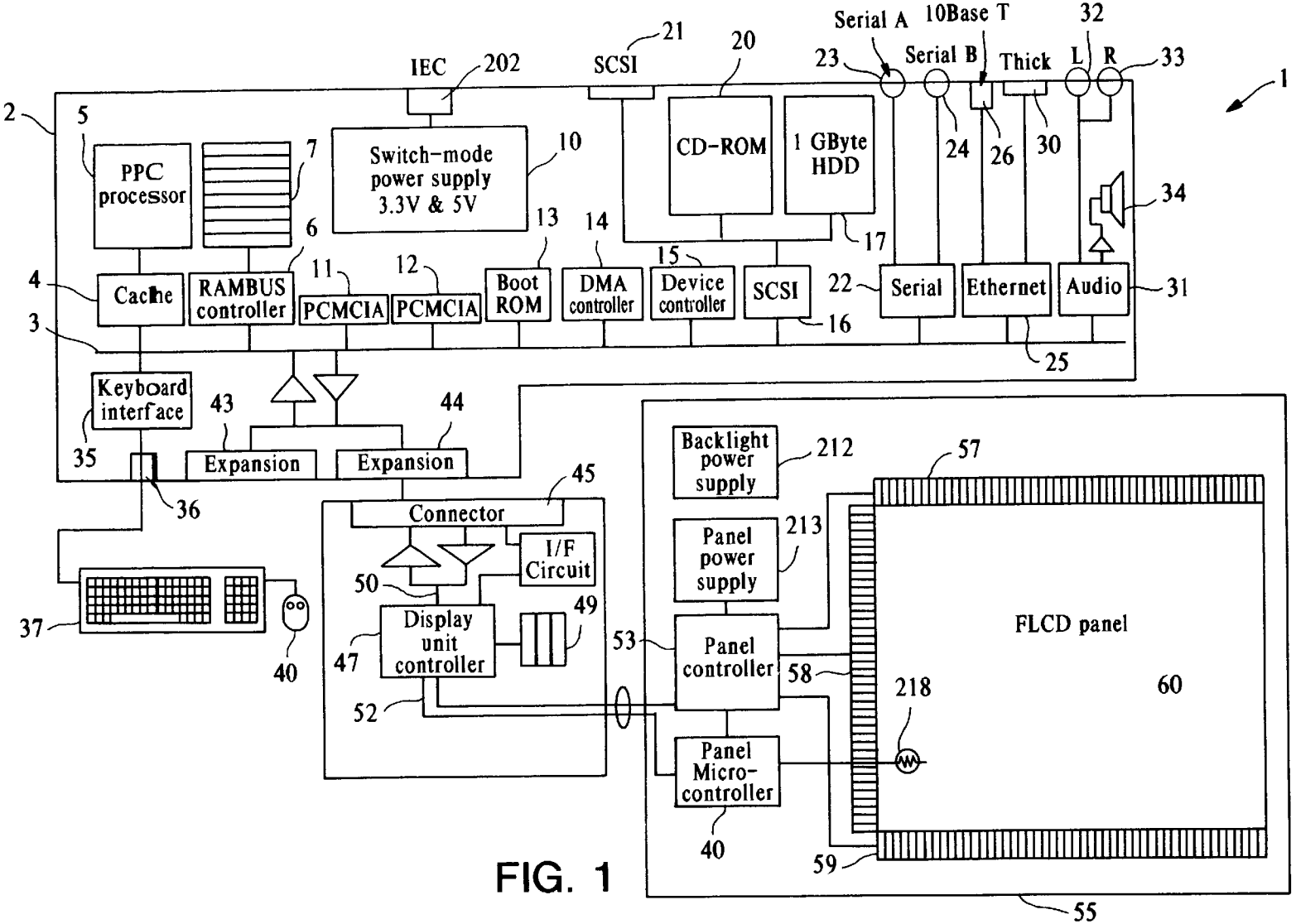
FIG. 1 illustrates an overall computer workstation system incorporating the preferred embodiment of the present invention.

Also connected to the bus 3 is a RAMBNS controller 6 which provides access to memory stored in an expandable memory store 7. Power to the base computer 3 is provided via power supply 10. Voltages provided include 3.3 Volts and 5 Volts as required.

In order to readily facilitate the transfer of information two memory card ports 11, 12 are provided for the insertion of memory cards. Preferably the ports are designed to take standard PCMCIA memory cards.

In order to ensure the proper initialization of the preferred embodiment upon power-up, a boot ROM 13 is provided for the storage of the requisite system codes Direct Memory Access I(DMA) controller 14 is provided for the control of transfer of data between the various secondary memory storage areas and the main memory store 7.

A device controller 15 provides the relevant 'glue logic' (known in the art) necessary to control the relevant devices by means of standard direct memory mapping techniques.

A SCSI interface controller 16 is provided for controlling secondary storage devices such as hard disk drive 17 and CD-ROM drive 20, in addition to providing a SCSI port 21 for the optional connection of additional devices.

A serial controller 22 is provided for the control of various serial ports such as serial port A 23 and serial port B 24, An ethernet controller 25 is used to control dual ethernet device ports 26 and 30 which are included to allow the preferred embodiment 1 to be interconnected in a network with other computer devices. Audio control is provided by an audio controller 31 which controls stereo audio channels 32, 33 in addition to an internal speaker device 34.

A keyboard interface controller 35 controls, via keyboard port 36, a keyboard 35 37 and mouse device 40. Also connected to the high speed bus 2, via two buffers 41, 42 is a series of expansion ports 43, 44. One of these expansion ports 44 is connected to a display interface unit 45.

The display interface unit 45 includes a display unit controller 47 which is designed, through means of connector 48, to interact with the base computer system 2.

The display unit controller 47 is further arranged to operate together with a frame buffer 49, and to take input information 50, from the computer system and to output via cable 52 packets of display line update information, containing pixel by pixel information and panel drive information, to a panel controller 53 of a panel system 55. The panel controller 53 controls the forwarding of the relevant information to a series of display drivers 57, 58, 59 for output of an image on a high resolution display 60. Displays such as ferro-electric liquid crystal displays, anti-ferro electric liquid crystal displays, TN liquid crystal displays, plasma displays and electro-luminescence displays can be used as the display 60.

Figure 2:
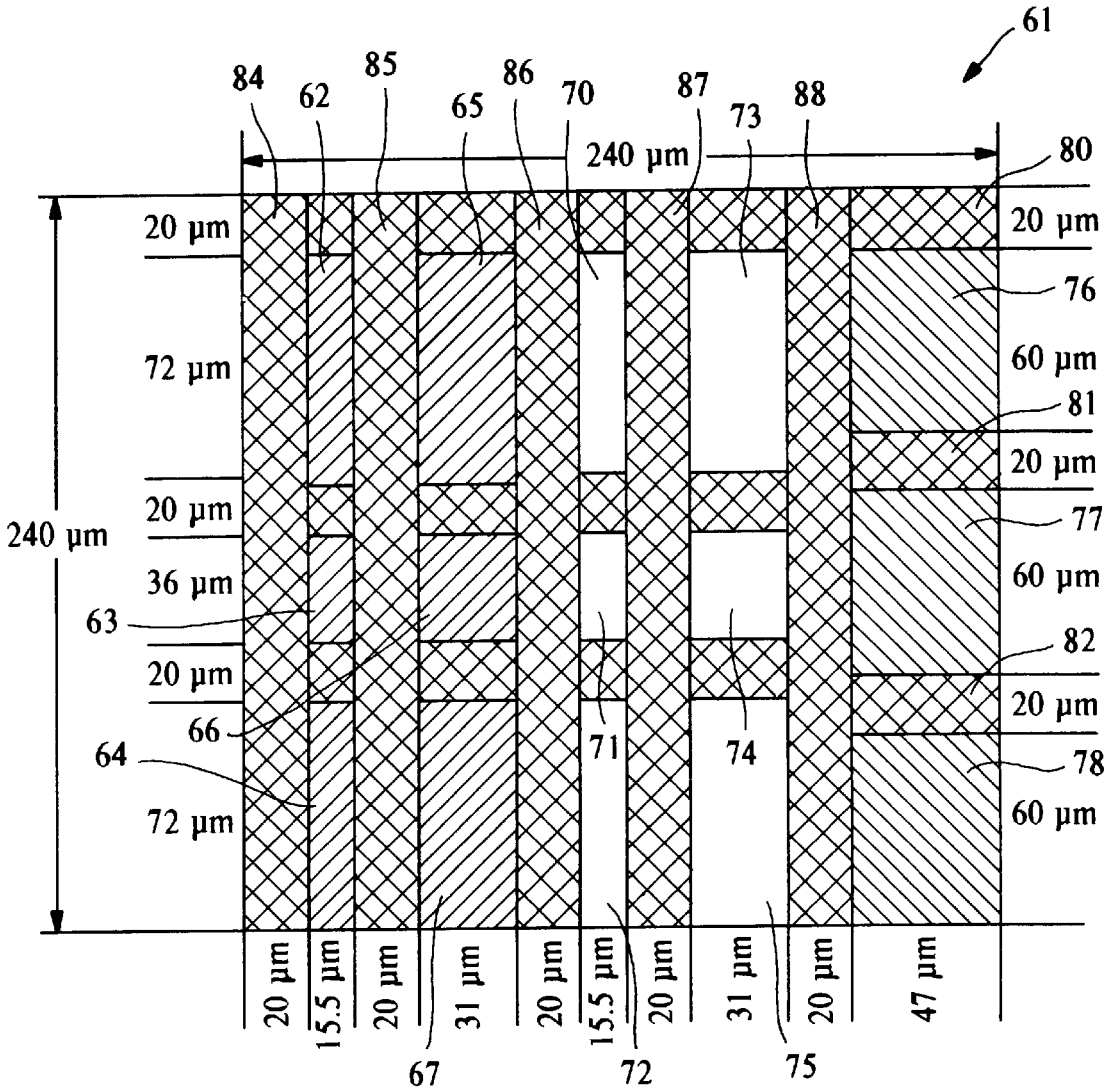
FIG. 2 illustrates a plan view of a preferred form of a single pixel of a FLCD display panel.

The display unit controller 47 of the present invention is arranged to operate with a pixel arrangement having multiple common lines. Referring now to FIG. 2, there is shown the preferred pixel arrangement. This arrangement has six sub-pixel areas 62–67 for the colour red, six sub-pixel areas 70–75 for the colour green, and three sub-pixel areas 77–78 for the colour blue. Therefore there are a total of 15 separate sub-pixel areas.

The pixel 61 of the second embodiment has three common drive lines 80–82 and five data drive lines 84–88. Combinations of common and data drive lines control the various sub pixel areas 61–67, 70–78 at their intersection, in accordance with the following table:

TABLE A

| Common Drive Line | Data Drive Line | Pixel Portion Area |
|---|---|---|
| 80 | 84 | 62 |
| 80 | 85 | 65 |
| 80 | 86 | 70 |
| 80 | 87 | 73 |
| 80 | 88 | 76 |
| 81 | 84 | 63 |
| 81 | 85 | 66 |
| 81 | 86 | 71 |
| 81 | 87 | 74 |
| 81 | 88 | 77 |
| 82 | 84 | 64 |
| 82 | 85 | 67 |
| 82 | 86 | 72 |
| 82 | 87 | 75 |
| 82 | 88 | 78 |

Each pixel 61 of the display is controlled by the display unit controller 47 to operate in a number of different modes. In a first mode called "Forced Fast Mode", the multiple common lines 80–82 are driven simultaneously and in son. The multiple drive lines of the pixel 84–87 are independently driven. Operation in Forced Fast Mode allows a line of pixels to be updated at a faster rate thereby increasing the rate of display update.

Figure 3:
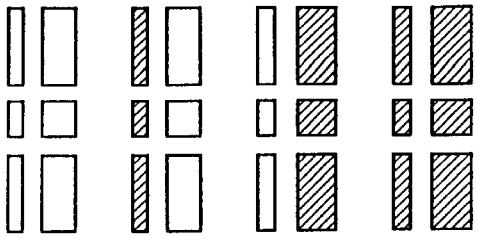
FIG. 3 illustrates the number of possible levels of the red and green portions of the single pixel of FIG. 2 when the display is driven in a forced fast mode.
Figure 4:
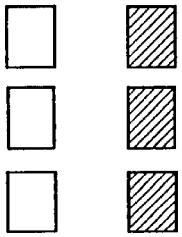
FIG. 4 illustrates the number of possible blue levels when the pixel arrangement of FIG. 2 is driven in a forced fast mode.

In FIG. 3 there are shown the different possible combinations of illumination for the red and green sub-pixel areas of the pixel when Forced Fast Mode is used. The possible levels indicated are 0, 5, 10 and 15. In FIG. 4 there are shown the possible levels (0,15) of the blue sub-pixel areas 76–78 (FIG. 2) when Forced Fast Mode is used.

Figure 5:
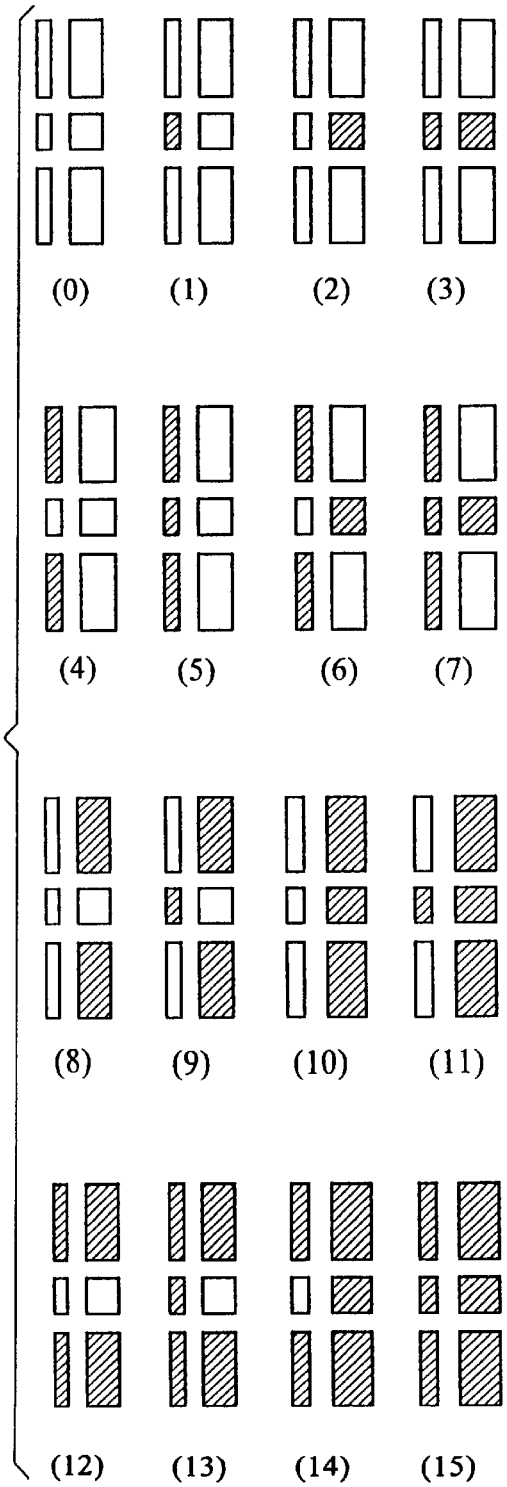
FIG. 5 illustrates the number of possible levels of the red and green portions of a pixel when the pixel is driven in normal mode.
Figure 6:
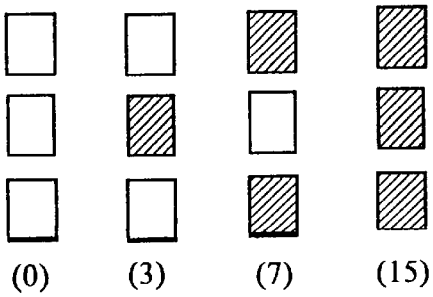
FIG. 6 illustrates the number of possible blue levels when the pixel arrangement of FIG. 3 is driven in normal mode.

In a second driving mode, called a "Normal Mode", the outer two common lines 80, 82 are initially driven in uruson and, subsequently, the inner common line 81 is further independently driven. This allows each pixel 61 to provide a multicolour multilevel, optically balanced pixel arrangement with 16 levels of red and green and four levels of blue when Normal Mode are utilised. In FIG. 5 there is shown the 16 possible levels of each of the red and green sub pixels. In such a pattern, it is important that each of the subpixel areas in the vertical direction has substantially the same average position. so that different gray scale patterns cause the pixel to change brightness only, without any apparent positional change. In FIG. 6, there are shown the four possible levels of blue (0, 3, 7, 15). It has been surprisingly found that less levels of blue are required.

Each pixel 61 is further capable of operating in a "Super Fine Mode". In Super Fine Mode the spatial position of each sub-pixel area 62–67, 70–78, is utilised as if it were a separate independent pixel with the displayed becoming a display of higher apparent resolution, the increase in apparent resolution being governed by the number of sub-pixel areas in each pixel. Super Fine Mode can sacrifice the chrominance accuracy of the displayed image in order to achieve this increase in apparent resolution. In the preferred embodiment. Super Fine Mode is implemented through the preparation of bitmaps for commonly used graphical objects, such as fonts. The bitmaps prepared have a one-to-one correspondence with the various sub-pixel areas 62–67, 70–78 to be illuminated and hence frame buffer 49 (FIG. 1) stores 15 bits of data for each pixel, with one bit for each sub-pixel area. Super Fine Mode will be further discussed hereinafter.

Figure 7:
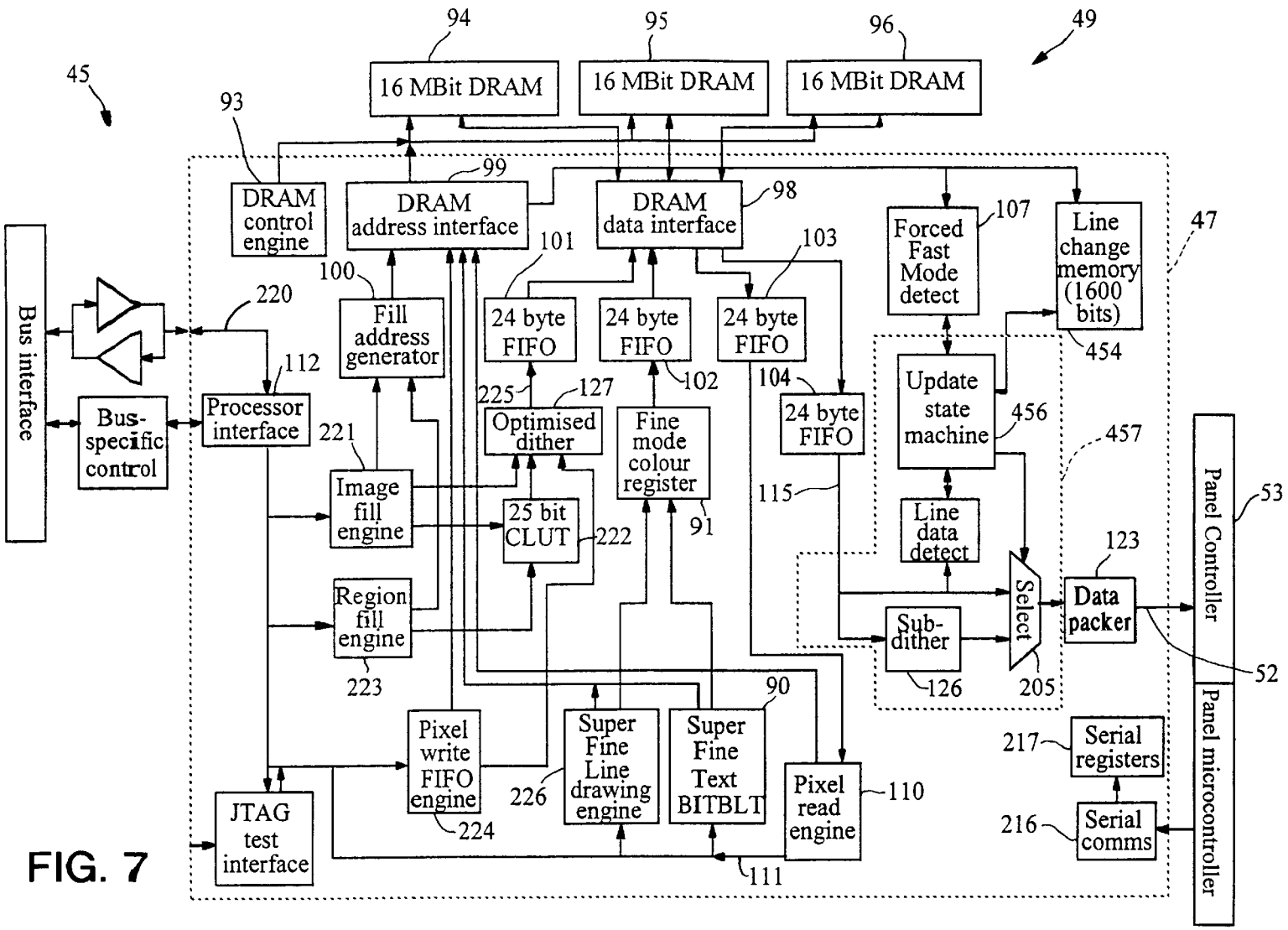
FIG. 7 illustrates, in more detail, the display unit controller of FIG. 1.

Referring now to FIG. 7, there is shown the display unit controller 45 in more detail. The display unit controller 45 is arranged to take input information in the form of pixel data and simple commands from base computer 2 and to write corresponding pixel data to a frame buffer 49 which includes 6 Megabytes of DRAM, under the control of a DRAM control engine 93, DRANM address interface 99 and DRAM data interface 98. The frame buffer 49 buffers the information to be displayed most often in a dithered form with the dither information for each pixel comprising 4 bits of red data, 4 bits of green data and 2 bits of blue data. Output information is taken from the frame buffer 49 and, as will be described below, is optionally "sub-dithered" by a sub-dither unit 126 before being packed together for output via lines 52 to the panel controller 53 (FIG. 1).

In order to increase the speed with which the display unit controller is able to operate, all information passing into or out of the frame buffer 49 is buffered by a series of FIFO queues 101–104.

The display unit controller 47 also includes a processor interface 112 connected to a 32-bit bus 220, arranged to allow the display unit controller to interface, with a minimum of external logic, with a wide range of different computers that can interface with the 32-bit bus 220.

An image fill engine 221 receives simple commands and pixel data from the processor interface 112 and fills a rectangular region within the frame buffer with the pixel data as provided by the computer 2. The address data of the image area to be filled is forwarded to a fill address generator 100. This address data consists of four parameters being the starting X address, the starting Y address, the extent of the image data in the X direction and the extent of data in the Y direction. The fill address generator generates the requisite addresses in left to right, top to bottom order, for forwarding to the DRAM address interface 99.

A region fill engine 223 fills a region defined by region addresses forwarded to the fill address generator with a colour defined by a predetermined entry of the CLUT 222.

Four modes for inputting pixel data to display unit controller 45 are provided, namely:

1. 8 bit colour mode: in this mode, colour data for four pixels is packed in each 32 bit word. The 8-bit pixel colour data is used to lookup an entry in a colour look-up table (CLUT) 222. The colour-lookup table 222 is a 256×25 bit memory. Colour data input to the CLUT 425 (being either 1 bit or 8 bits) is converted to 8 bits for each of red, green, and blue, plus a 1 bit write mask.

2. 1 bit per pixel mode: in this mode, each processor word defines 32 pixels. The colour of each pixel is defined by a 24 bit current colour register in the CLUT 222.

3. 16 bit colour mode: in this mode, two pixels are transferred with every 30 32 bit word. There are 5 bits for each of the red, green, and blue colour components. These components are fed directly to an optimised dither unit 127 for halftoning.

4. 24 bit colour mode: in this mode, each processor word is a 24 bit colour, and is directly halftoned by dither unit 127.

The image fill engine 221 is provided to allow low speed computers to interact with the display unit controller 45 to display still or moving images with minimum processing. This enables a processor with the equivalent power of an Intel 386 micro processor to update a 320×240 pixel movie window on the display 60 at 30 frames per second. The display 60 is also able to display this window at 70 ms per line. It is therefore possible for a computer to keep up with the maximum display rate of the display 60 when displaying pixel image data.

A pixel write FIFO engine 224 is provided for the efficient writing of individual pixels into the frame buffer 49. It consists of a FIFO which is 8 words deep with each word consisting of:

A 24 bit colour

A 12 bit X address

A 12 bit Y address

A FIFO is used so that pixels can be written without requiring the computer 2 (FIG. 1) to wait for the pixel write operation to complete before the next write operation (i.e. a system of posted writes is implemented). This allows for eight writes to be posted before any processor delay is imposed. Because the DRAM of the frame buffer 49 is operated in burst access mode, the latency for a particular write operation is highly variable.

The dithering unit 127 converts the 24 bit colour data (input from pixel images, colour specifications, or the CLUT) into halftoned data for the display 60. The 24 bit colour data is converted into 16 levels (4 bits) of red, 16 levels of green, and four levels (2 bits) of blue as will be described hereinafter.

The halftoned dithering unit output data 225 is forwarded to the frame buffer 49 via the FIFO 101 and DRAM data interface 98.

A fine line drawing engine 226, is used in the drawing of fine lines into the frame buffer 49. This is of particular use in applications such as Computer Aided Design (CAD) applications and is provided as an option in the display unit controller 45. The fine line drawing engine 226 accepts line descriptions from the processor interface 112 which contain the following information:

Start pixel coordinates (X & Y)

Start sub-pixel coordinates

Slope Value

Octant Value

Line Length in sub-pixels.

The fine line drawing engine uses a modified version of a standard line drawing digital differential analyser (DDA) which steps through the grid of subpixels (e.g. 5×3) at a high speed, the results over each pixel are accumulated and forwarded to the frame buffer 49 via a fine mode colour register 91, FIFO 102 and DRAM data interface 98.

A fine text bitwise block transfer engine (BITBLT) 90 enables the high speed bitwise block transfer for the movement of information directly from the computer system 2 to the frame buffer 49, This is particularly advantageous when used to move previously created image data such as system fonts directly from the computer to the frame buffer 49.

Modern computer displays are used to display many different types of objects, which can be stored within the computer system 2 in many different forms. For example, images can be stored in the form of a pixel by pixel representation of the object, or the images can be stored in object outline format only. The outline of a font is stored, for example, in the format of straight lines or cubic curves such as splines. This outline is then 'rendered', by the computer 2, into a corresponding pixel form before being sent for display on display 60. Some advantages of using outline information are that the objects are able to be stored in a more compact form and that the object based data can normally be quite easily scaled up and down or rotated, depending on its desired display format. A disadvantage is that the outline information must be rendered into a bit map form each time the image is to be displayed. This disadvantage can sometimes be alleviated by 'caching' or storing frequently displayed objects in pixel mapped form, a process known to those skilled in the art.

One very common image displayed by a computer display is letters or characters of a particular 'font'. The design of a particular font is normally carried out by an artist who has a number of criteria to be used in the design of the font, including aesthetic suitability, case of reading and intended purpose. Companies such as Adobe, Truetype or Agfa market a wide range of different fonts for use on computer displays and printing devices. As previously stated, these fonts often take the form of various outline information in the form of splines and perhaps hinting (eg. inter-character spacing) or other information used in displaying the font.

Figure 8:
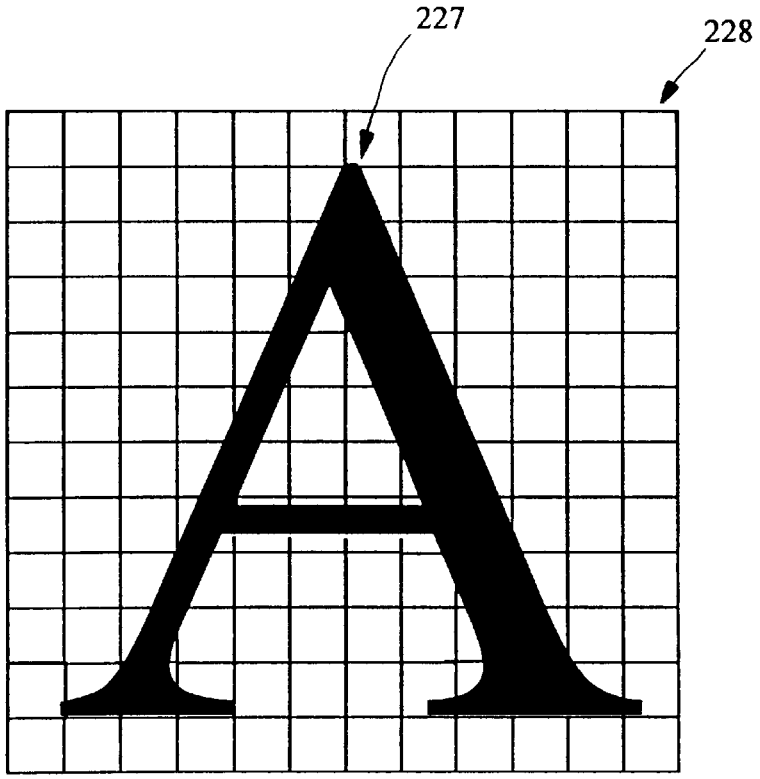
FIG. 8 illustrates the rendering of a Times Roman character 'A'.
Figure 9:
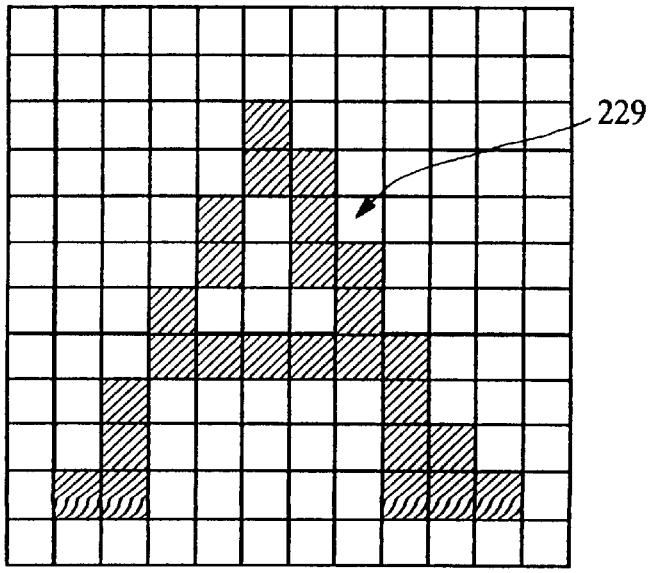
FIG. 9 illustrates normal result produced when rendering the character A of FIG. 8.

The rendering of outline image data by computer 2 for display on a display device 60 can result in the introduction of a number of artifacts, as a result of the display 60 having a finite resolution. Referring now, to FIG. 8 there is shown, by way of example, a primitive of object image data in the form of a Times Roman character 'A' 227 which is to be rendered on a 12×12 array of pixels 228. In a first attempt at rendering, each pixel is either replaced by the object's colour or left unchanged. Referring now to FIG. 9, there is shown the notional results of this rendering process. As can be seen from this example, the rendering has distorted the original letter to produce an image with severe 'stair-casing' or 'jaggies' 229 as they are known in the art, especially along the edges of the letter.

Methods to reduce the extent of these jaggies have been developed in the art and are known generally as anti-aliasing. These methods involve increasing the apparent resolution of the rendering by area sampling techniques. One such technique is to alter the colours of say square 6 to be a colour intermediate of the object to be rendered and the background of the object, with both unweighted and weighted sampling techniques being used. For a description of anti-aliasing techniques reference is made to a standard textbook such as 'Computer Graphics: Principles and Practice', Second Edition by Foley et. al. published 1990 by Addison-Wesley Publishing Company, Inc.

Our perception of colour usually involve three quantities, namely hue, saturation and luminance. Hue refers to the dominant wavelength of the colour displayed and distinguishes among the colours such as red, green, purple and yellow. Saturation refers to how far the colour is from a grey of equal intensity, and luminance is a measure or the eye's perceived intensity of the reflected light. It has been found that the eye is highly sensitive to alterations in spatial luminance, the sensitivity often being more significant than the sensitivity to errors in the hue of an image.

Therefore, a trade off can be undertaken between any intensity errors and any hue errors that may have resulted from the rendering process, with the intensity errors being considered to be of more significance. This is achieved by using the spatial resolution of the areas of the pixel of the pixel arrangement of FIG. 2, to achieve a much higher quality rendering resolution.

Figure 10:
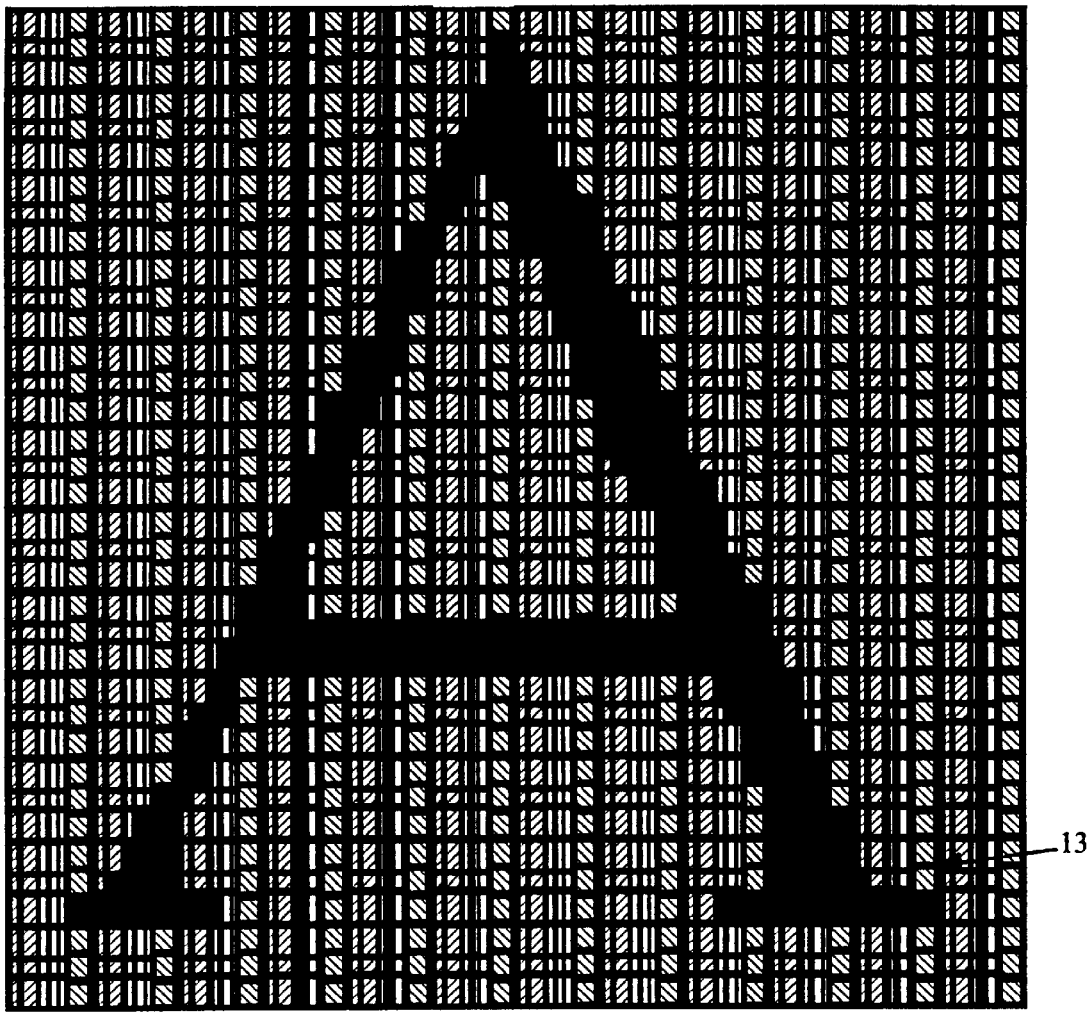
FIG. 10 illustrates rendering the character A in a "Super Fine" mode on a display constructed in accordance with the preferred embodiment.

Referring now to FIG. 10, there is shown a rendering of a black Times Roman letter 'A' on a "white" background in accordance with the preferred embodiment of the present invention. As the background is "white", a colour defined by the illumination of all the pixel areas of a pixel, the letter itself is "black". This "black" is a colour created by not illuminating any areas of the pixel.

The rendering of the leter 'A' in FIG. 10 achieves a much higher resolution by paying special attention to the edges of the letter and treating each pixel as made up of a number of sub-pixels, the number being equal to or greater than to the number of different illumination areas of the pixel. In this particular rendering, this has the effect of increasing the resolution of the display almost to the level of the number of illumination areas.

The method of the preferred embodiment is preferably implemented by the creation of special 'bit map' arrays for the particular fonts which are to be used in the display. The best method of creation of a particular bitmap is by the hand of a graphic artist experienced in the creation of fonts. The need to create the fonts by hand is a consequence of fonts often having artistic and aesthetic qualifies that are difficult to automate, in addition to automated methods often producing inferior results.

However, methods of automation of the bitmap creation are highly desirable, especially for images which may not be often in use and the need therefore only occasionally arises to display chose images. Automatic methods are also of great value in situations where the novice user of the computer system is responsible for the creation of the object to be rendered on the screen. Hence a simple automated method will now be presented. This conversion process assumes that outline information is generally available, and the steps for conversion are as follows:

1. Determine the outline graphics that are required to be displayed,
2. Determine the size of the outline graphics, measured in row and column pixels, and
3. Scale the outline graphics by a subsampling grid factor, where the subsampling grid is chosen to provide an accurate representation of the subpixel arrangement.

Figure 11:
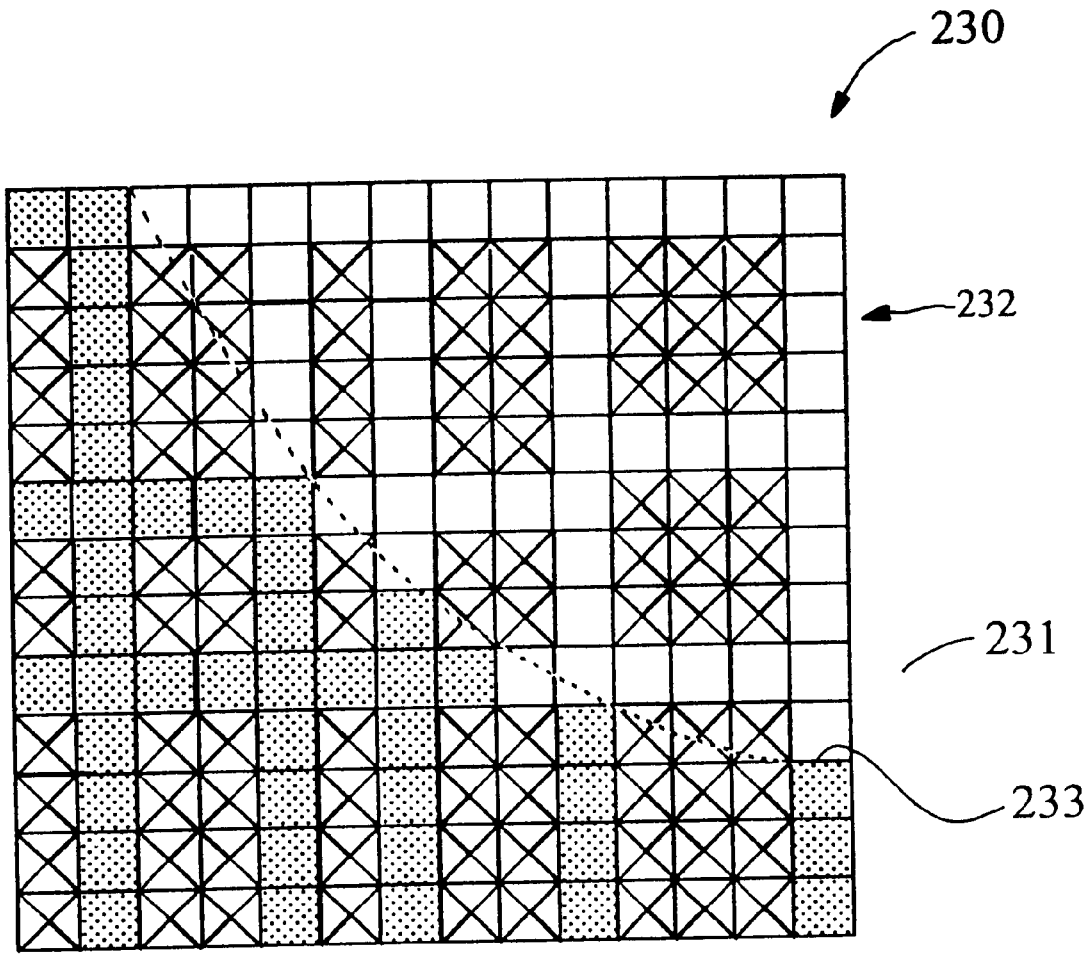
FIG. 11 illustrates the method or determining which portions of a pixel 2 illuminate.

Referring to FIG. 11, there is shown an enlarged view of pixel 230 of FIG. 10, including subsampling pixel grid 231 and pixel portions 232. In the present example, the subsampling grid is divided into 15 row squares by 13 column squares.

Next the following steps are implemented:

4. Render the required outline graphics 233 to a bitmap buffer memory of a size equal to the size of the scaled outline graphic, and
5. Count how many sub-sample points are turned on in each pixel portion 232. If greater than or equal to 50% of the sub-pixel is turned on, then mark the sub-pixel portion to be turned on.

In the present embodiment, the final results of this process is a determination of which sub-pixel portions should be illuminated. This information can be stored in a bitmap, with one bit for each sub-pixel portion, with a pixel bitmap being stored in 15 bits.

The above example is directed to the common occurrence of black text on a white background. Extension to other bi-level colour combinations can be easily achieved. Such bi-level colours, in this case include the mixture of colour formed from equal portions of one or more of the primary colours of the display, being the colours red, green, blue or cyan, magenta and yellow. The automated methods described above can be applied to bi-level colours by alteration of step 5 to only count those pixel portions that would be used in the normal creation of that colour. Other colour edge transitions can be achieved by the hand creation of bitmaps to determine the most aesthetically pleasing result.

The above described method of automation does not always produce totally perfect results. Text displayed using this method will often, on close examination, contain colour fringes. Often these fringes are generally minor and difficult for the human eve to detect. However the colour fringes will often become more severe as the width of the graphic objects decrease. In particular, the above method is often ineffective when used to render outline graphics comprising extremely thin, substantially vertical lines, something that did not form part of the example. Hence, the use of bitmaps produced by hand tuned methods is recommended in this case.

The bitmaps for a range of pixels can be stored or created in accordance with the operating system or graphical user interface of computer system 2 (FIG. 1) and a sub-pixel by sub-pixel representation for each desired pixel can be sent to BITBLT engine 90 (FIG. 7) for storage within frame buffer 49. The BITBLT engine 90 generates all of the addresses required for writing a rectangular array of sub-pixels to frame buffer 49. The frame buffer 49 includes 15 bits of storage for each pixel, with one bit stored for each sub-pixel area 62–67, 70–78. A BITBLT engine 90 is provided to transfer multiple pixels at once to the frame buffer 49, with the maximum number of pixels in a single transfer being an area 32×32 pixels wide.

When utilizing this "Super Fine Mode", the same set of bitmaps can be utilized to display a selection of colour combinations. These eight "bi-level" colour combinations comprise the combinations of red, green and blue primary colours, being the colour combinations formed from combinations of the primary colours of the pixel arrangement of FIG. 2.

A fine mode colour register 91 is loaded with a value corresponding to the desired background and foreground colours and acts as a filter when it is desired to utilise Super Fine Mode. All the sub-pixel areas can then be written to either the background or the foreground colour, depending on the data in the fine mode colour register 91.

A DRAM control engine 93 is responsible for controlling all access to the DRAMs 94–96 of frame buffer 49, in addition to the production of row and column address strobes and other required control signals for the DRAMs 94–96. The DRAMs 94–96 include three 16 MBit memory arrays organised as 2 Mbit×8 bits and are operated in parallel to provided an increased data rate, resulting in a 24 bit DRAM data interface bus. The DRAMs are operated in burst mode, with variable length bursts depending upon the type of access.

A DRAM data interface unit 98, is a high speed interface able to accept or transmit data to the frame buffer 49 in 40 nsec (25 MHz) and consists of bi-directional latched buffers and multiplexers.

The speed of the DRAMs 94–96 will depend on the speed of the display 60 (FIG. 1) used with the display unit controller 47. The highest data rates to and from the frame buffer 49 will occur when the many lines on the display 60 are being changed by the computer 2 (corresponding to many lines being written to and read from the frame buffer 49) as well as the display operating at its maximum speed in accepting information. Although dependent on the specifications of the display 60, in most cases an access time of 50 nsec is considered to be adequate.

A DRAM address interface unit 99 determines the appropriate address for access to and from the frame buffer 49. These addresses are forwarded from fill address generator 100 Pixel write FIFO engine 224, superfine line drawing engine 226, Super Fine Teat BITBLT 226 and pixel read engine 110 corresponding data is forwarded via pixel read and write FIFOs 101–104 to DRAM data interface 98. The row and column portions of the addresses are multiplexed at times controlled by the DRAM control engine 93. The DRAM address interface 99 includes a look-ahead detection of the next address from each of its sources. Hence, if the next address required is in the same DRAM row, the DRAM control engine 93 maintains the DRAM in burst mode.

When each new line is written into the frame buffer 49 by the DRAM address interface unit 99, the address of the line is forwarded to a line change memory 106 and a forced fast mode detection unit 107. The line change memory 106 includes a one bit flag for every line of the display 60. The flag is used to indicate if the line has been changed since the last time it was updated. Hence the flag is set whenever the frame buffer memory for that line is written to by DRAM address interface 99. The flag bit is also cleared by an update state machine 108 whenever that line is updated on the display 60, except when the line is updated in Forced Fast Mode (as will described below). The line update memory is read by the update state machine 108 in order to determine the optimum update order.

In order to be able to read current pixel values from the frame buffer 49, a pixel read engine 110 is provided. The pixel read engine 110 forwards the required address to DRAM address interface 99 and the required frame buffer value is read out via DRAM data interface 98 and FIFO 103, to pixel read engine 110.

As noted previously, pixel colour information is forwarded to the display Unit controller 47 in the form of 24 bits of colour data divided into 8 bits of red, green and blue. Frame buffer 49 buffers only dithered colour information with 4 bits each of red and green and 2 bits of blue. Pixel read engine 110 converts this information into a 24 bit value, however only the most significant four bits of red and green values, and only the most significant two bits of blue values are valid. This information is forwarded via line 111 back to the host computer 2 via a processor interface 112. If true 24-bit colour information is required, this will have to be implemented by the host computer 2 through the means of a software backing frame buffer.

The display unit controller 47 Is capable of a number of optimisations to increase the speed with which it can display images having, multiple common lines. In many cases, the data to be displayed on all of the common lines (in the case of the preferred embodiment, the number of common lines being three), will be the same. In many other cases, the data on two of the common lines will be the same.

When the display is operating in its Normal Mode, the data on the two outer common lines 80, 82 (FIG. 2) will be the same. This will be the case unless the fine text BITBLT 90 has been used to write a bit map patten for a pixel in the line directly to the frame buffer 49. Further, all three common lines may be identical where the image displayed on a line is composed entirely of the 32 colours which result from the use of two bits for the red and green colour and one bit for the blue colour. In these two situations, advantage can be taken of the state of a lines data to increase the speed of updating a line display 60.

Figure 12:
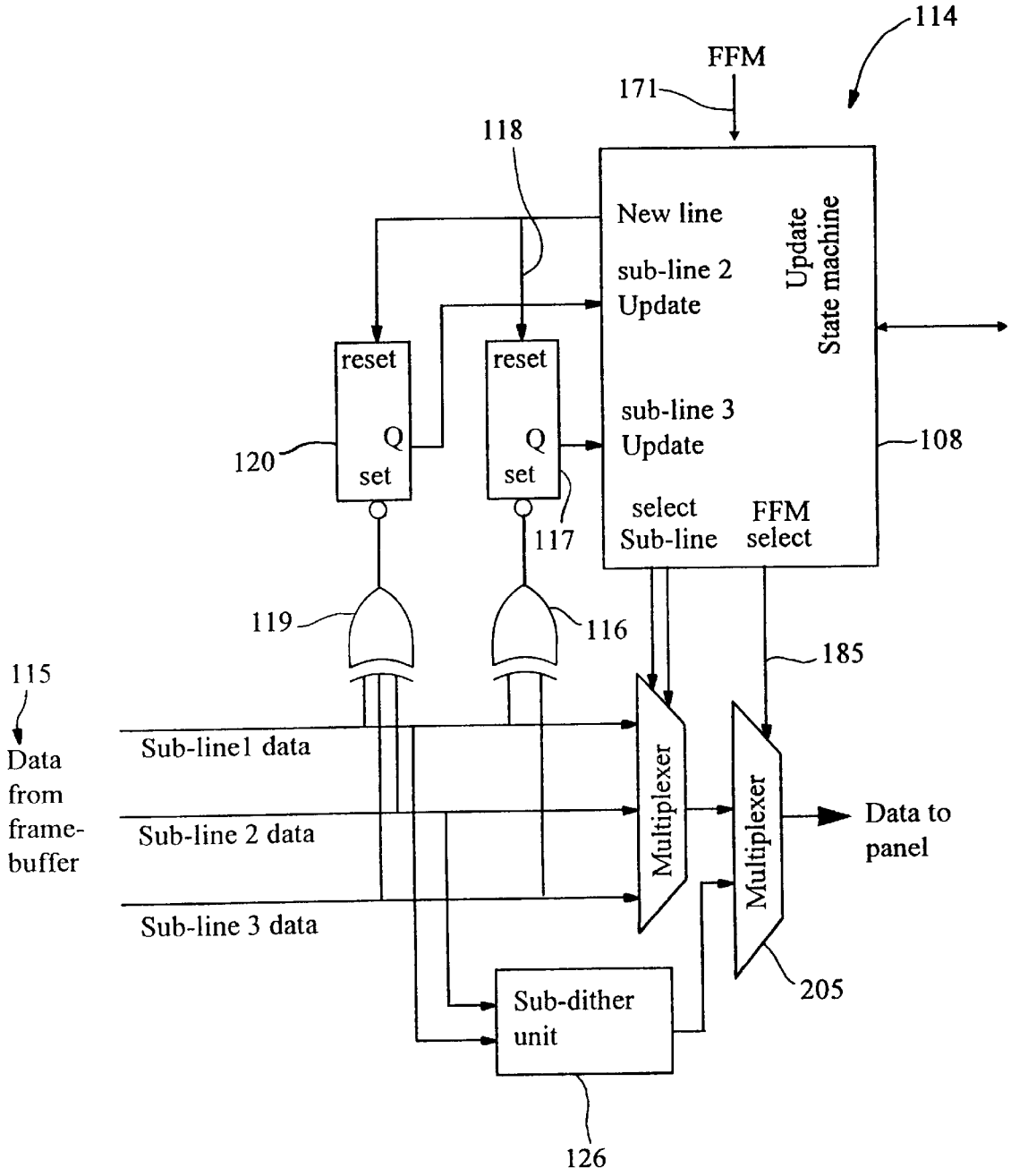
FIG. 12 illustrates a portion of the displays unit controller of FIG. 1 in more derail.
Figure 13:
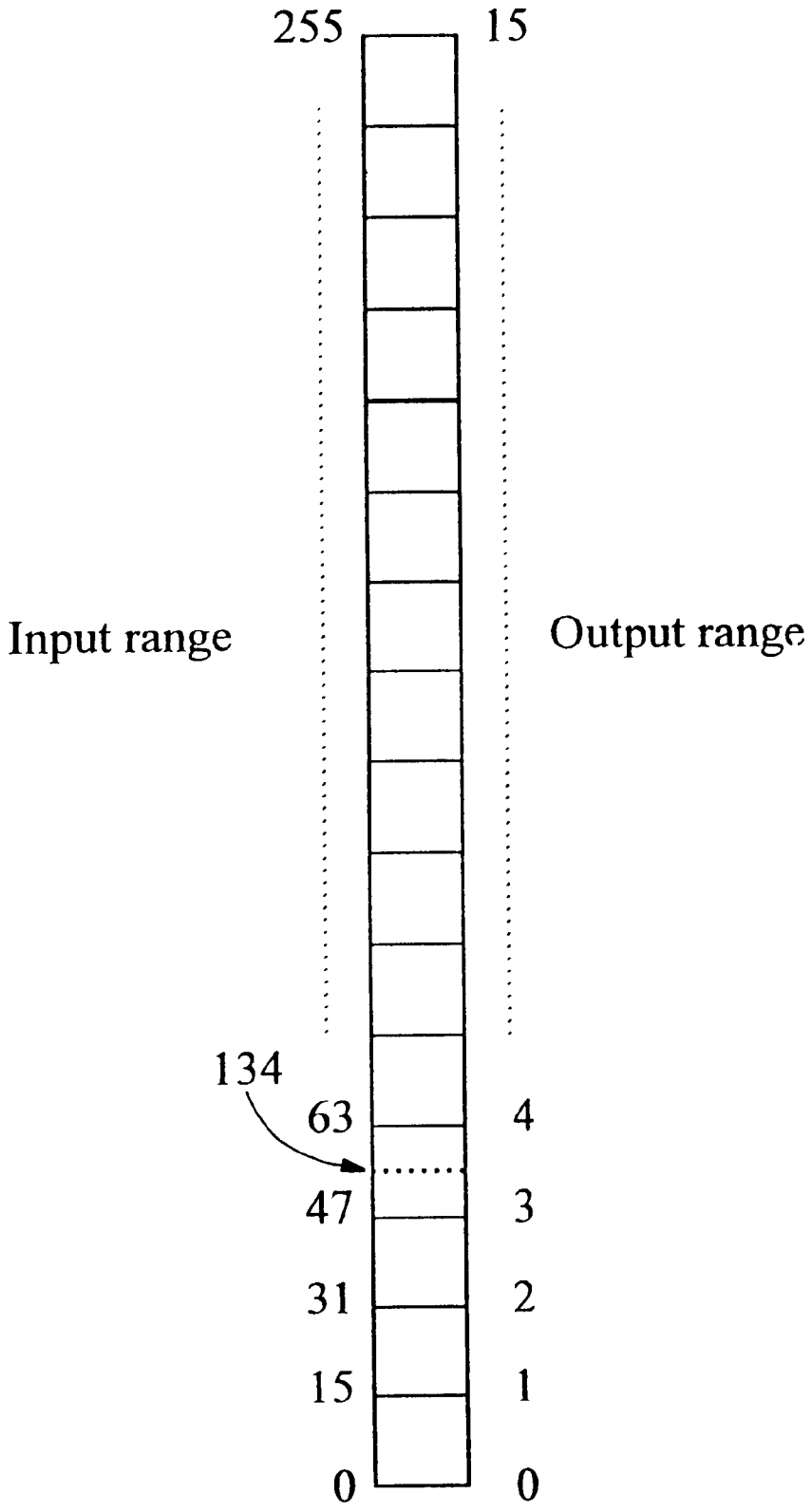
FIG. 13 illustrates the process of multilevel dithering.

Referring now to FIG. 12. there is shown the portion 114 (FIG. 7) of the display unit controller 47 in more detail. The portion 114 is designed to detect differences in sub-lines of a line of pixels. This is achieved by monitoring the line data 115 as it is read from the frame buffer 49 (FIG. 2). In order to determine if the sub-lines 1 and 3 contain the same data, the data from these lines is compared by feeding it through an Exclusive OR gate 116, the result being used to set a flip-flop 117. The flip-flop 117 itself is cleared 118 by the update state machine 108 at the start of each new line.

Similarly, in order to determine if all three sub-lines are the same, a comparison 119 is also made between the data contained on the first second and third sub-lines. The result of this comparison for each pixel is used as a set input to a second flip flop 120, with the flip-flop being reset 118 at the beginning of each new line. The outputs from the flip-flops 117, 120 are forwarded to the update state machine 108 (whose operation will be describe, in more detail below).

The update state machine 108 determines firstly whether all three sub-lines contain the same data. If this is the case then the corresponding common lines of all three sub lines are to be driven simultaneously and the relevant mode information to achieve this is forwarded to the panel system unit 55 (FIG. 1) via data packer unit 123 (FIG. 7).

Similarly, if the outer two lines are the same then the data for these lines is forwarded to the data packer unit 123 with the relevant mode bits followed by the data for the middle sub-line being read out of the frame buffer 49 and forwarded to the data packer unit with its relevant mode bits being set. If each sub-line is to be updated separately, then the mode bits for this state is sent to the panel system unit 53, followed by the reading of data for sub-line 2 from the frame buffer 49, followed by reading the data from the frame buffer 49 for sub line 3. This assists in minimising the DRAM data read rates from the frame buffer 49. When the update state machine 108 is in Forced Fast Mode, sub-lines 1 and 2 are read simultaneously and sub-line 3 can be ignored.

Although the description of portion 114 of FIGS. 2 and 4 has been directed to the line update characteristics of the display unit controller 47, it is anticipated that, in order to decrease the processing speed requirements, it is desirable to increase the cycle time of the portion 114 by processing groups of pixels in parallel, methods of processing pixels in parallel being readily apparent to those skilled in the art. The number of pixels is dependent on the relevant technology used to implement the display unit controller 47.

A Forced Fast Mode detection unit 107 (FIG. 7) is used to provide for an increased panel update speed when a substantial amount of motion is occurring on the display 60. This increased update speed is accompanied by only a small decrease in the image quality of the display for a short period of time. Whenever the number of outstanding lines to be updated is above a certain threshold, the update state machine 108 enters a forced fast mode of updating. In this mode, all three sub-lines of a line of pixels on the display 143 are driven simultaneously, with the sub-pixels of each data line being forced to have the same values, thereby allowing the display to be driven at an update speed three times that which may be otherwise achievable.

As all the sub-lines are driven together, the quality of the image displayed in forced fast update mode (FFM) is temporarily that of a 32 colour display, with digital halftoning being utilised, through the use of sub-dither unit 126, to obtain an improved form of display.

Figure 14:
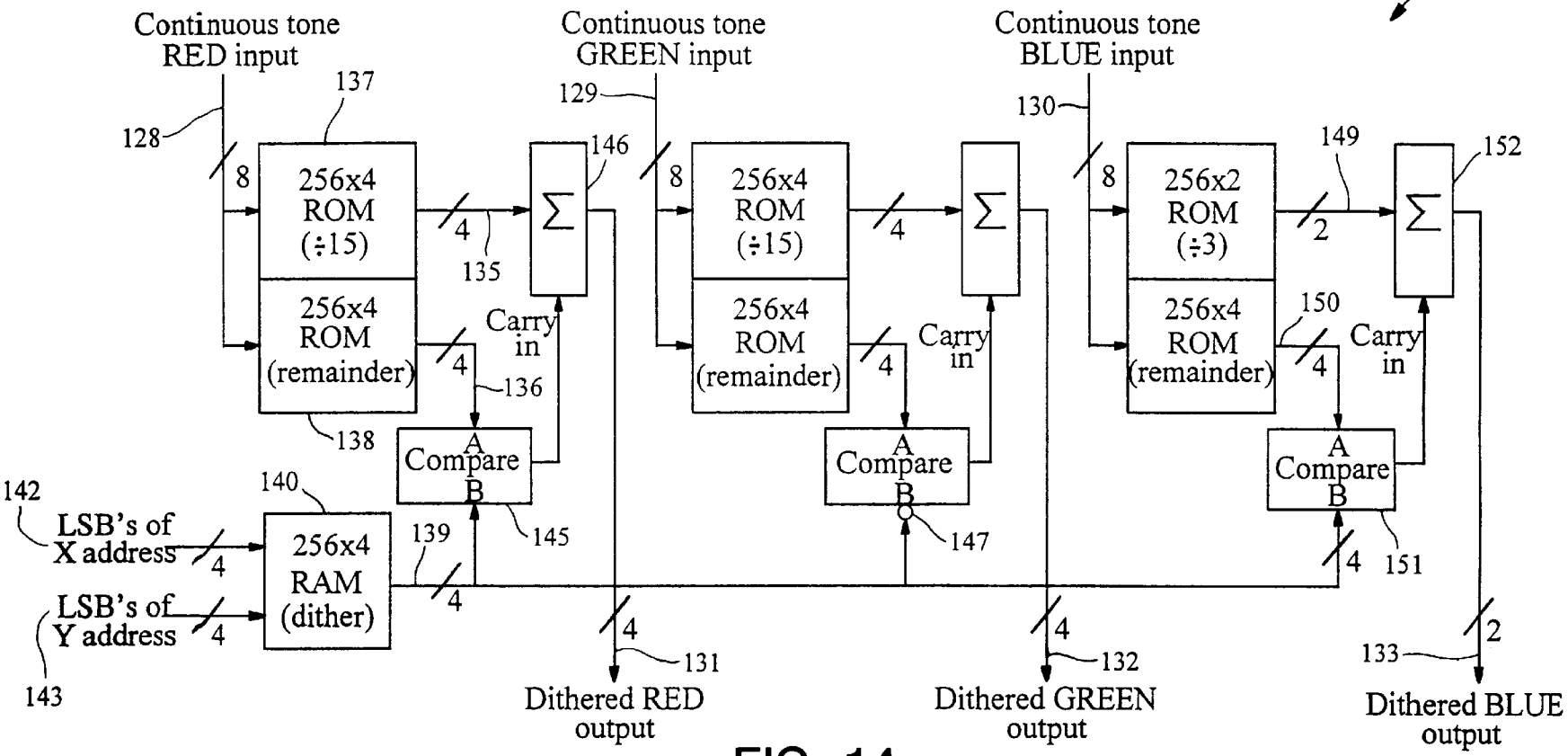
FIG. 14 illustrates the optimised dither unit of FIG. 7 in more detail.

With reference to FIG. 7, pixel data to be written to the display 60 is dithered by an optimized dither unit 127. Pixel data is input to the optimized dither unit 127 in the form of continuous tone 24 bit RGB colour (8 bits of red, green and blue). In FIG. 14, there is shown an example of the multi level dither method implemented by the optimized dither unit 127. The input range 0 to 255 is divided into 15 intervals delineated by the sixteen lines 0 to 15. An input value 134 of, say, 53 is divided into two parts, one representing the level at the bottom of the interval (level 3) and one representing the portion of the interval that the value of 53 takes. This can be simply implemented by dividing the input value 16 by the number of intervals, in this case 15, which gives a result of 3 remainder 8. The remainder portion is then dithered against a set of dither matrix values in the normal manner to produce a dithered remainder value that is either zero or one. This is then added to the integer portion of the division to determine a final output value of 3 or 4, depending on the result of the dithering process.

Referring now to FIG. 14. there is shown the optimised dither unit 127 in more detail. This unit is responsible for dithering the 8-bit Red 128, Green 129 and Blue 130 input values to output four bits of dithered red 131 and green 132 output as well as two bits of blue output 133.

The red input 128 is divided into its relevant integer 135 and remainder 136 portion by means of Read Only Memories (ROMs) 137, 138. The division is implemented by means of ROMs as a full hardware divide is likely to be too complex as a non-bin division process is required. A dither matrix value 139 is simultaneously read out of a dither matrix RAM 140 The dither matrix RAM 140 defines a 16×16 array of 4 bit dither matrix values. The value to be read out is determined by the 4 least significant bits 142, 143 of the current pixel address location. The dither matrix value 139 is compared 145 with the remainder portion 136, and the output is added to the integer portion 135 by adder 146. to produce a red dithered output value 131.

The same method is used to derive a dithered green output value 132 from the green input value 129. However, the dither matrix value 139 is preferably inverted 147 with respect to the normal red and blue values. This inversion process has been found to produce improved pictures, reducing the amount of luminance noise in the final dithered image.

As there are only four levels of blue output 133, the dithering of the blue input proceeds by dividing the input by 3, producing an integer portion and a remainder portion. The remainder portion only being defined to the level of four bits. A similar process of comparison 151 and addition 152 is then used to produce dithered blue output 133.

Referring again to FIG. 7, the sub dither unit 126 takes pixel input data, intended for display of pixels in Normal Mode, comprising 4 bit red, 4 bit green and 2 bit blue component and 're-dithers' or 'sub-dithers' the input pixel components so that the output from the sub-dither unit 126 comprises 2 bit red output 2 bit green output and 1 bit blue output suitable for use in Forced Fast Mode.

Figure 15:
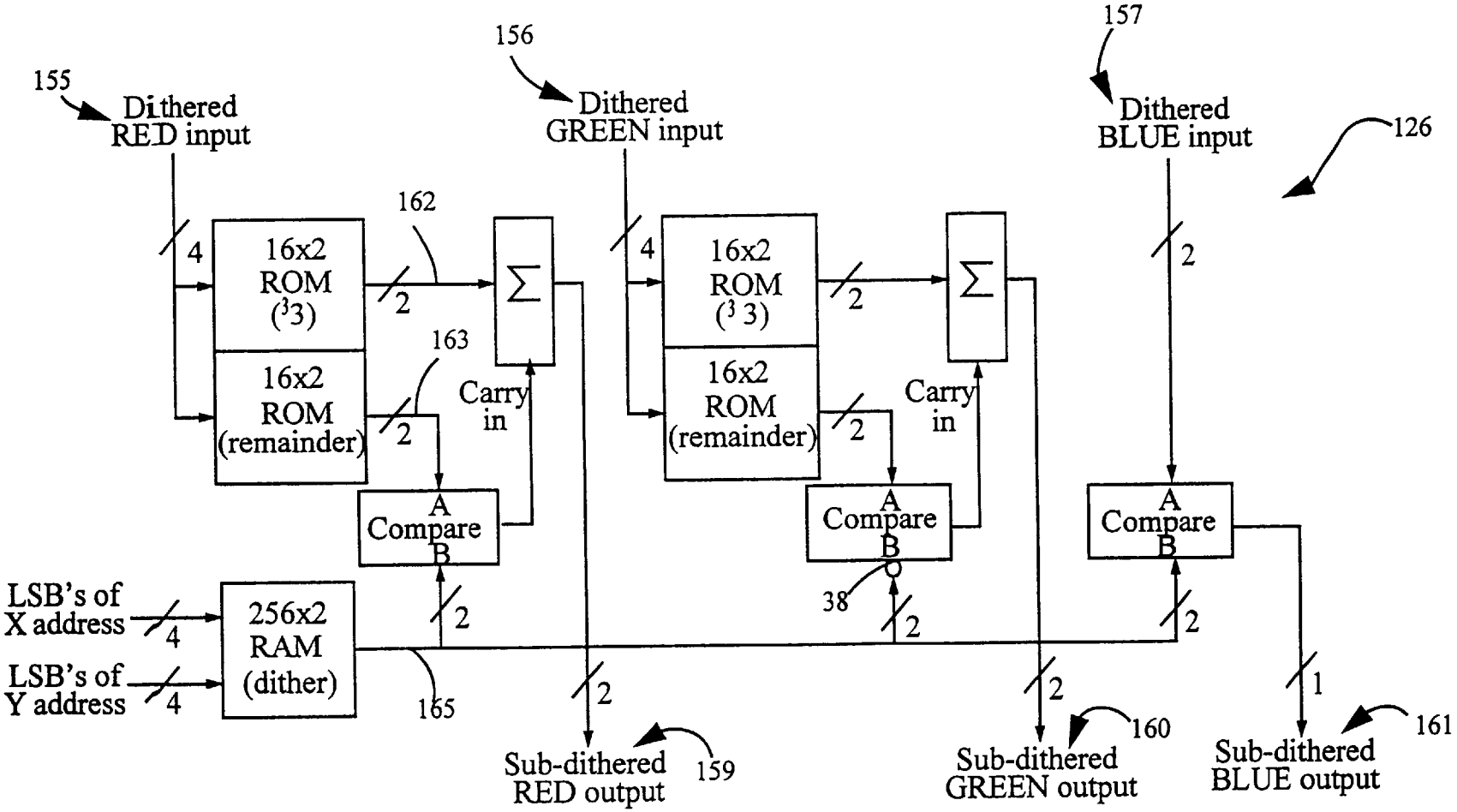
FIG. 15 illustrates the sub dither unit of FIG. 7 in more detail.

Referring now to FIG. 15 there is shown, in more detail, the sub dither unit 126. This unit is responsible for tog a four bit red input 155, a four bit green input 156 and a 2-bit blue input 157 and producing a 2-bit red 155 and green 156 output in addition to a 1 bit blue output 15A.

The red output 159 is produced by taking the red input 155 and dividing it by 3 to form an integer 162 and remainder part 163. Again division in the form of a ROM lookup table can be used. The remainder portion 163 is again compared against a dither value 165 and the result added to the integer portion to form dithered output 159. The green output 160 is derived in a similar manner to the red output 159, however, the dither matrix input value 165 is again inverted 166. The blue output value 161 is derived by comparing the blue input 157 with the dither matrix value 165.

When utilizing Forced Fast Mode, once the number of remaining lines to be updated drops below a predetermined threshold, the Normal Mode of updating is restored and this mode proceeds to restore all of the panel to the full possible image quality. An entire horizontal band of pixels encompassing those lines which are displayed in Forced Fast Mode (FFM) will suffer a slight temporary degradation in image quality. Those regions suffering degradation will include horizontally adjacent areas not logically associated with the portion of the image that is moving or changing. Under most circumstances, the degradation may not be noticeable, however, and usage of FFM can be easily disabled if necessary resulting in a display having a slower update speed.

Figure 16:
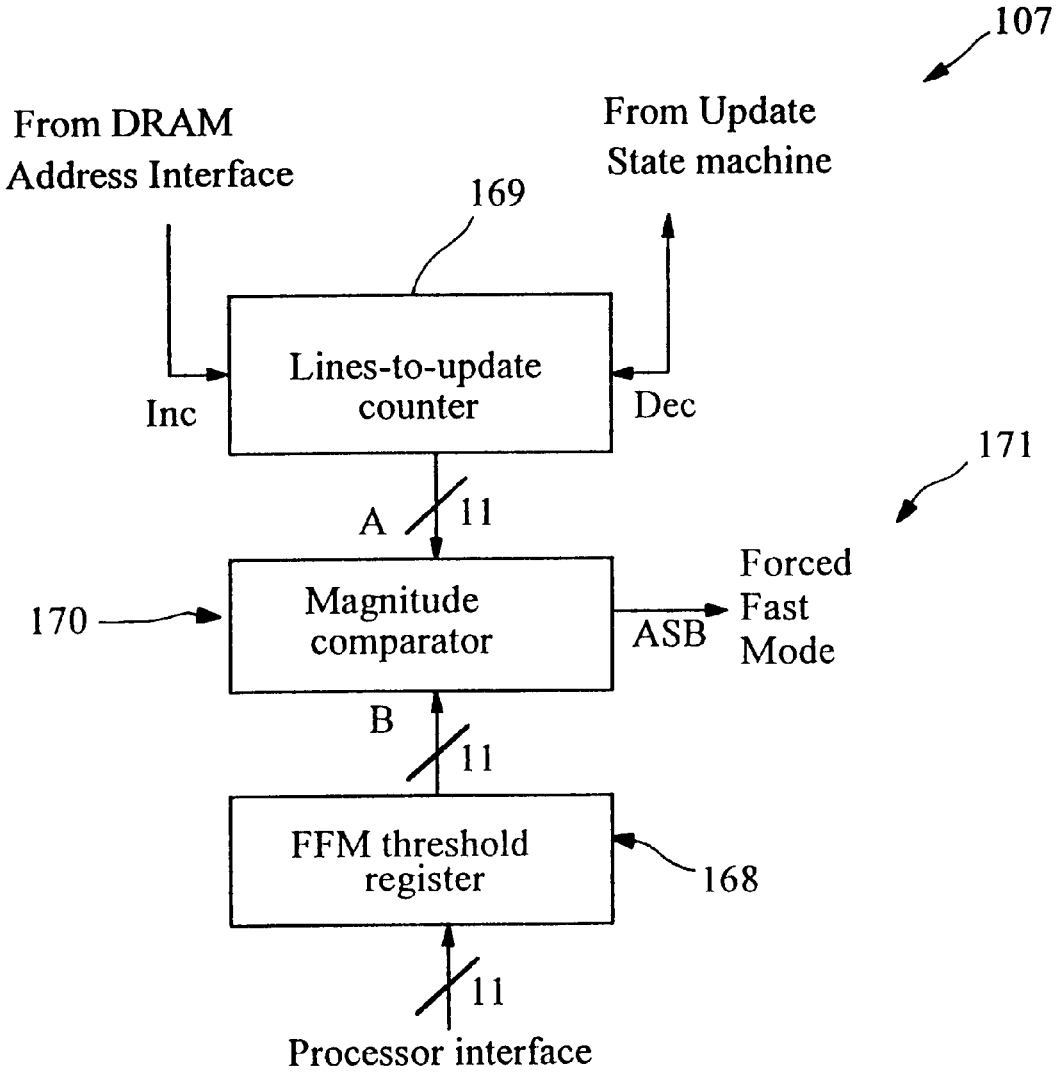
FIG. 16 illustrates the Forced Fast Mode Detection Unit of FIG. 7 in more detail.

Turning now to FIG. 16. there is shown the forced fast mode detection unit 107 of FIG. 7 in more detail. This includes a FFM threshold register 168, which can be preloaded from the processor interface, to contain a desired level value before FFM is activated. The number of outstanding lines to be updated is contained in a lines co update counter 169. This counter is incremented by the DRAM address interface 99 (FIG. 7), each time a line in the frame buffer 49 is altered, and decremented by the update state machine 108 (FIG. 7) each time a line is read out of the frame buffer 49 to the display 60.

A comparator 170 is used to compare the two values in FFM threshold register 168 and lines to update counter 169 to determine if the Forced Fast Mode should be entered. A resultant FFM signal 171 is sent to the update state machine 108 (FIG. 12). The Forced Fast Mode can be effectively turned off by loading a suitably high value in FFM threshold register 168.

Figure 17:
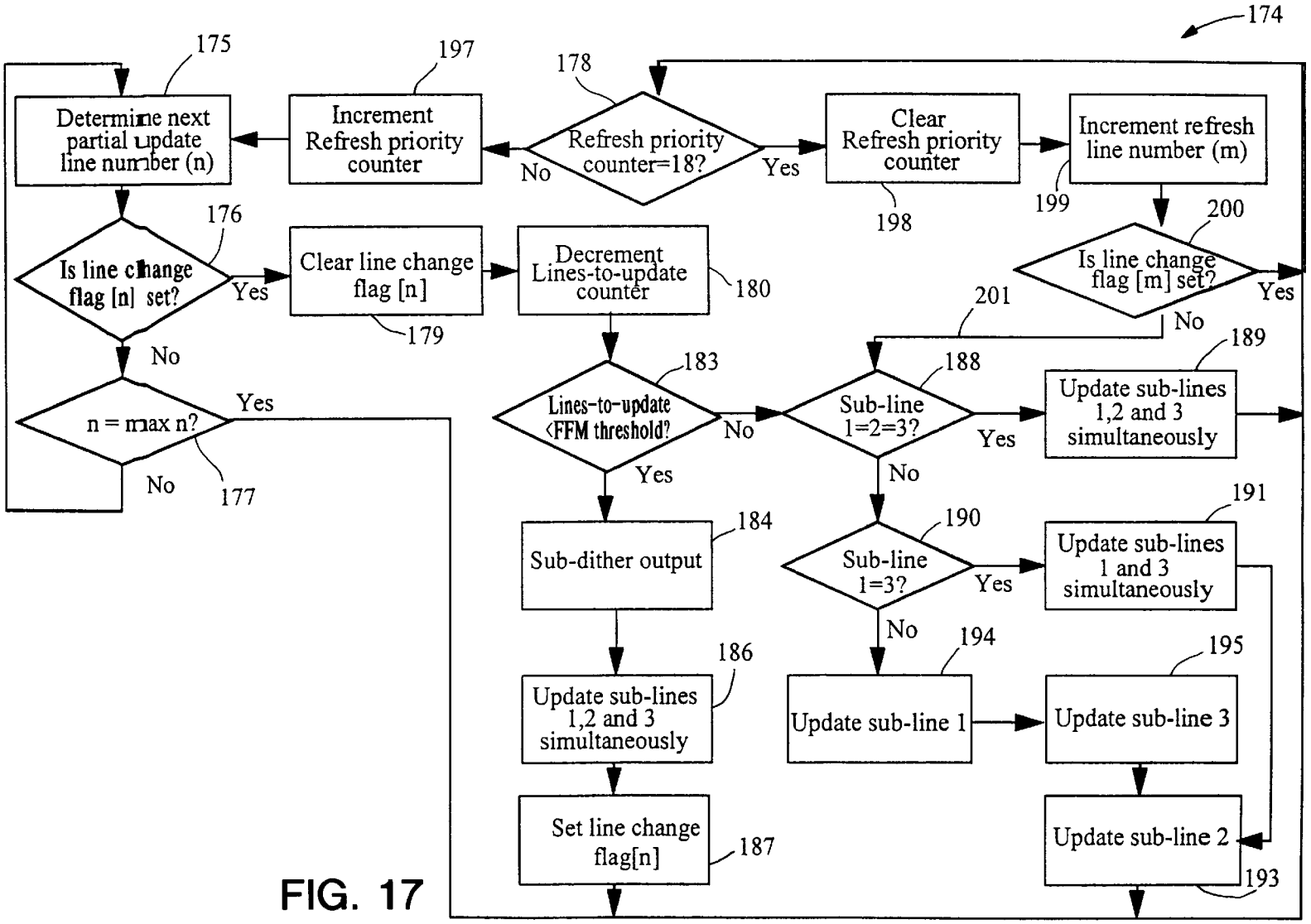
FIG. 17 illustrates a flow chart which is incorporated as part of the update state machine of FIG. 2.

Referring now to FIG. 17 there is shown a flow chart 174 of the update method implemented by the update state machine 108. The update state machine 108 is responsible for determining the relative priority of lines to be updated on the display 60. The method implemented is to update those lines which have been written to the frame buffer 49 and altered in the line change memory 106. The other lines of the display are updated in an interleaved fashion as a 'background process'.

The method shown in the flow chart 174 begins by incrementing a counter (n) 175 to determine the next candidate line for updating. The line change set flag of the line change memory 106 (FIG. 7) is examined 176 to determine if the candidate line has been altered since it was last examined. If it has not then the update state machine checks to see if the end of the screen has been reached 177. If not, then the update state machine returns to step 175. Upon reaching the end of the screen the refresh priority portion 178 of the state machine is executed.

Upon a determination that the candidate line requires updating 176, the flag is cleared 179, and a signal is sent 180 to the forced fast mode detection unit 107 (FIG. 7) to decrement the lines to update counter 169 (FIG. 12).

Once a candidate line has been determined to be updated, a decision must be made as to what mode to update the line in. A determination is first made 183 as to whether the line should be updated in Forced Falst Mode. This determination will be dependent on the state of the FFM signal 171 (FIG. 16). If FFM is to be used then the subdither data is selected 184 via a signal 185 (FIG. 12) to mutiplexor 205. All three common lines are then updated simultaneously 186. The line change flag for the candidate line is also set 187 so that when the FFM is no longer activated, the candidate line will be, at a later time, rewritten in a higher image quality mode.

If a determination is made 183 to not enter FFM, then the pixel data for the line is read from the frame buffer 49. As previously described with reference to FIG. 12, a determination 188 is made as to whether the sub-lines of the display are the same. If the three sub-lines are the same, they are updated simultaneously and the update state machine continues to a refresh decision 178.

If all three sub-lines are not the same, a determination 190 is made as to whether the outer two sub-lines are the same, in accordance with the state of the flip-flop 117 (FIG. 8) at the end of a line, in which case sub-lines 1 and 3 can be updated simultaneously followed by the updating of sub-line 2.

If the two outer sub-lines are not the same, as will be the case when the image displayed includes portions written to the frame buffer via fine text BITBLT 90, then each line must be individually updated 193, 194 and 195. At the end of these updates the update state machine returns to refresh priority determination 178.

A refresh priority counter is used to ensure that after every eighteenth line update cycle a background refresh takes place. Hence, if the current value of the refresh priority counter is not equal to eighteen 178, the refresh priority counter is incremented 197 before returning to process the next line 175.

Once the refresh priority counter reaches eighteen, a refresh cycle is undertaken whereby the refresh priority counter is cleared 198 and the next refresh line is determined. If this line has its line change flag set in line change memory 106 (FIG. 7), then the refresh cycle is skipped 200, otherwise, the line is refreshed 201.

As seen in FIG. 7, the pixel information for the particular line, or sub-line portion thereof, is forwarded to the data packer unit 123. This packages the data required to represent a line as a line data packet.

Figure 18:
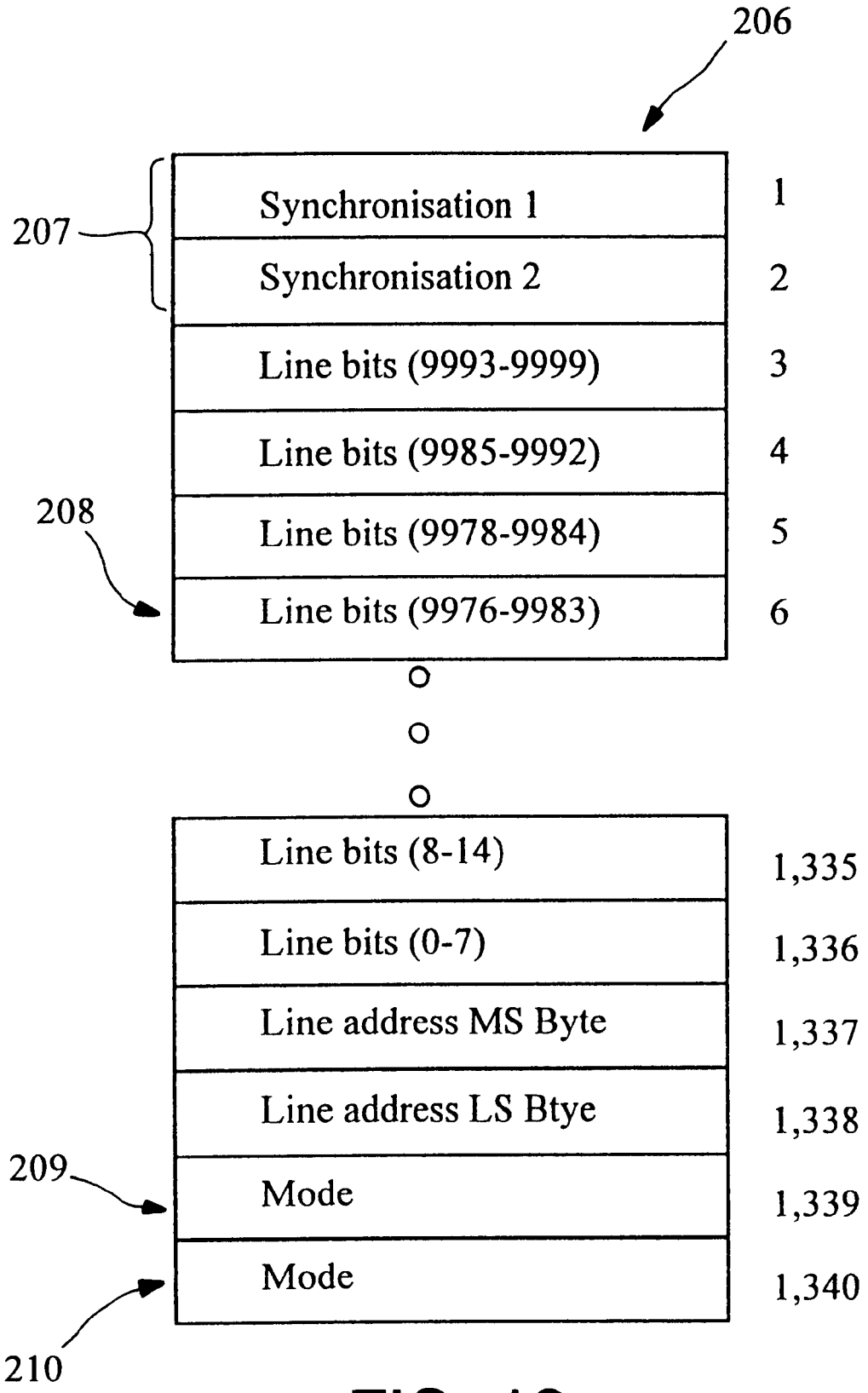
FIG. 18 illustrates a display data packet utilised by the display system.

Turning now to FIG. 18, a data packet 206 includes.

A synchronisation word 207 (two bytes long,).

Line data 208, dependent on the number of pixels present. In the preferred embodiment 1,334 bytes of line data is present for a display having 2000 pixel per line. Some compression can be achieved through the packing of three pixels into 15 bits in two bytes.

Mode data 209, specifying the combination of sub-lines to be written for the current line.

Spare Data Area 210, provided for future expansion.

Conveniently, the mode data area 209 is sent after the line data area 208. This is advantageous as the mode data cannot be determined until after the line data has been read from the frame buffer 49. Placing the mode data last avoids the need to store the line data.

The data for each pixel on a line is sent in reverse order, with the last pixel on a line being sent first. This allows for data to be shifted into the relevant data line drivers of the display panel 60.

The synchronisation word 207 should normally, be redundant as each packer will have a predetermined length. However, as seen in FIG. 1, in the case of a data transmission fault, synchronisation may be lost between the display unit controller 47 and panel controller 53. In this situation, the panel controller 53 is able to re-synchronise on the occurrence of the synchronisation word 206, with the synchronisation lock occurring when synchronisation words occur 1,340 words apart.

As line data consists of data packed into 15 bit words, the synchronisation word is distinguished in that it is the only word that has its bit 15 set. As it is possible that the transmission fault may also cause the loss of byte synchronisation, causing bit 7 to be indistinguishable from bit 15, a two word synchronisation word is provided.

As seen in FIG. 1, the display unit controller 47 sends its data to the panel system unit 55. The panel system unit 55 includes a backlight power supply 212 designed to control a backlight (not shown) for a display 60. The display 60 is arranged as containing 2,000 pixels on a line by 1,600 lines of pixels, with each pixel in the form as previously described with reference to FIG. 2. Data in packets from the display unit controller 47 are forwarded by cable 52 to the panel controller 53 which forms part of a panel system 55.

The pixel system 55 and display interface unit 45 communicate via a serial communications link connected between a panel microcontroller 215 contained within panel system 55 and a serial communications port 216 (FIG. 7) contained within display unit controller 47, provided for receiving information from the panel system 55. This information is stored in a serial register 217 of the display unit controller 45 and includes the current operating temperature of the display panel. The operation speed of ferroelectric liquid crystal devices is known to be temperature sensitive. Hence, there is a temperature sensor 218 (FIG. 1) is provided, placed on the display to measure the current display temperature. The temperature value is forwarded to microcontroller 215 where it undergoes analog to digital conversion before being forwarded to serial register 217.

As noted previously with reference to We pixel layout 61 of FIG. 2, each pixel of the display 60 is controlled by three common lines and five drive lines. Therefore, for a 2,000× 1,600 pixel display, the total number of power lines on the display will be:

5×2,000=10,000 drive lines

3×1,600=4,800 common lines

The large number of drive and common lines are connected at the exterior of the display 60 to corresponding driver chips 57, 58, 59. Connection can be by, means of ansiotropic connectors and tape automated bonding (TAB) techniques known to those skilled in the art. The odd pixels drive lines are connected at the top of the display, the even pixels at the bottom, and the common drive lines are connected at the side.

Figure 19:
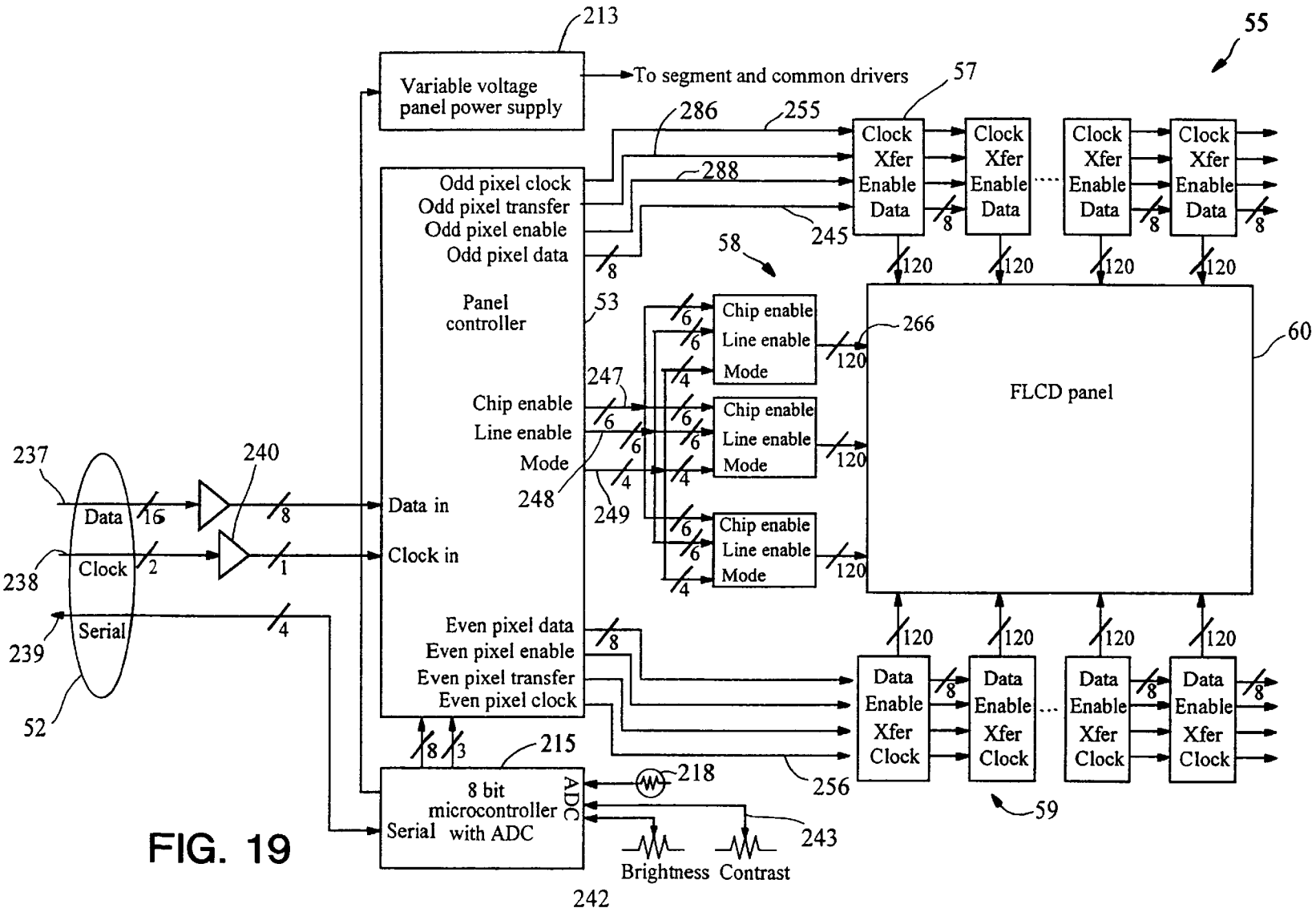
FIG. 19 illustrates a panel controller and FLCD panel of FIG. 7 in more detail.

Referring now to FIG. 19, there is shown a schematic view of the panel system unit 55 in more detail. The panel system unit is responsible for the demultiplexing and distributing of data from the display unit controller 47 (FIG. 7) to the various data and common drive lines of the display. Data is fed to the panel system unit 55 by means of the cable 52 which contains data 23, clock 238 and outgoing serial information 239. The data and clocking information is fed to the panel controller 53 via line balancing receivers 240.

As noted previously, the panel system unit 55 also includes a temperature sensor 218 connected to the display panel 60 and designed to sense the current temperature of the display 60. As is known in the art, the maximum operating speed of a ferroelectric switching element is dependent on its operating temperature. A reading obtained for the panel temperature is input to the analogue to digital converter of the 8-bit microcontroller 215. Additional controls are provided for allowing the setting of contrast 242 and brightness 243 respectively. The temperature, contrast and brightness levels are determined by the microcontroller 215 and forwarded to the panel controller unit 53, in addition to being forwarded to the display interface unit 45 (FIG. 7) via serial line 239. Additionally, a variable voltage panel power supply 213 is used to provided the required power to the display and associated circuitry, under the control of the microcontroller 215.

The panel controller 53 divides pixel data for each line into odd (numbered) pixel data and even pixel data. The odd pixel data is feed along odd pixel data bus 245 to a first of a series of TAB mounted pixel drivers 57. Similarly, even pixel data is fed to a series of even pixel driver TABs 59. Pixel data is shifted from one TAB driver to the next via shift registers within each driver TAB.

Once the pixel data is in its correct position, one of the common line driver TABs 58 is activated by a TAB chip enable signal 247. Each common line driver TAB 58 controls 120 common lines or 40 separate lines of pixels. A line enable signal 248 from panel controller 53 determines which line of pixels, within a common line driver TAB, to enable. Similarly a mode signal 249 determines whether one, two or three common lines will be simultaneously enabled.

Figure 20:
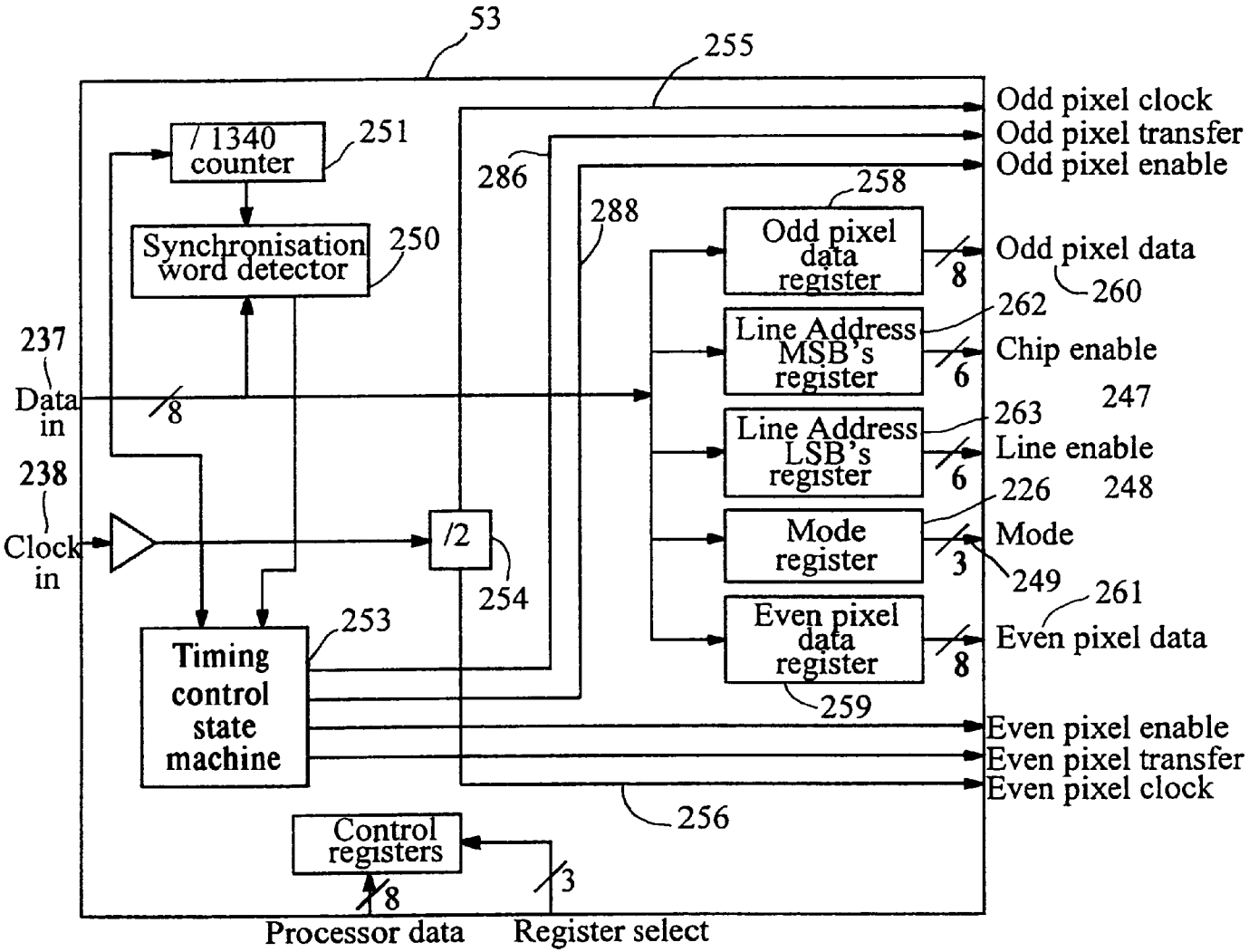
FIG. 20 illustrates the panel controller of FIG. 1 in more detail.

Moving now to FIG. 20, there is shown, in more detail, the panel controller unit 53 of FIG. 19. The panel controller unit 53 is primarily responsible for the distribution of data to the various driver TAB chips 57, 58. 59 of FIG. 19.

The input data packet for ore line comprises 1340 bytes, with the first two bytes being synchronisation detection bytes. Therefore, there is provided a synchronisation word detector 250 to detect the occurrence of a synchronisation word, which is the only word which has a bit 15 set Normally the detector is not required as synchronisation should occur every 1340 bytes, however the synchronisation detector is required should, as explained previously. Synchronisation be lost A synchronisation counter 251 is provided to signal when a new line should be starting, and is reset by, timing control and state machine 253. The synchronisation counter 251 is preferably programmable to allow for the control of different panel sizes.

The input clock signal 238 is divided by two 254 to provide an odd pixel clock 255 and an even pixel clock 256 which are used to drive the odd and even pixels of a given line respectively.

Following the synchronisation word, there are 1,334 bytes of pixel data, with the last pixel being sent first. Each pixel data is sent to an odd pixel data register 258 and an even pixel data register 259, before being sent out on odd pixel data output 260 and even pixel data output 261.

Subsequent to the pixel data, the relevant line address is forwarded as a two word byte. The most significant byte (MSB) is latched by a MSB register 262 and the next least significant byte address (LSB) is latched by LSB register 263. Finally the mode of driving the panel is latched by mode register 264.

As seen in FIG. 19 and FIG. 20, the signals from the panel controller 53 are used to drive the series of common line driver TABs 58. A first signal 247, output from the MSB register 262 is used to select the desired common line driver TAB. A second signal 248, derived from the line address LSB register 263, is used to determine which lines are to be enabled within the selected common line driver TAB. Finally, the number of lines to be driven simultaneously is determined by the mode signal 249 derived from the mode register 264.

Each of the common line driver TABs 58 is used to control and drive 120 display common lines 266.

Figure 21:
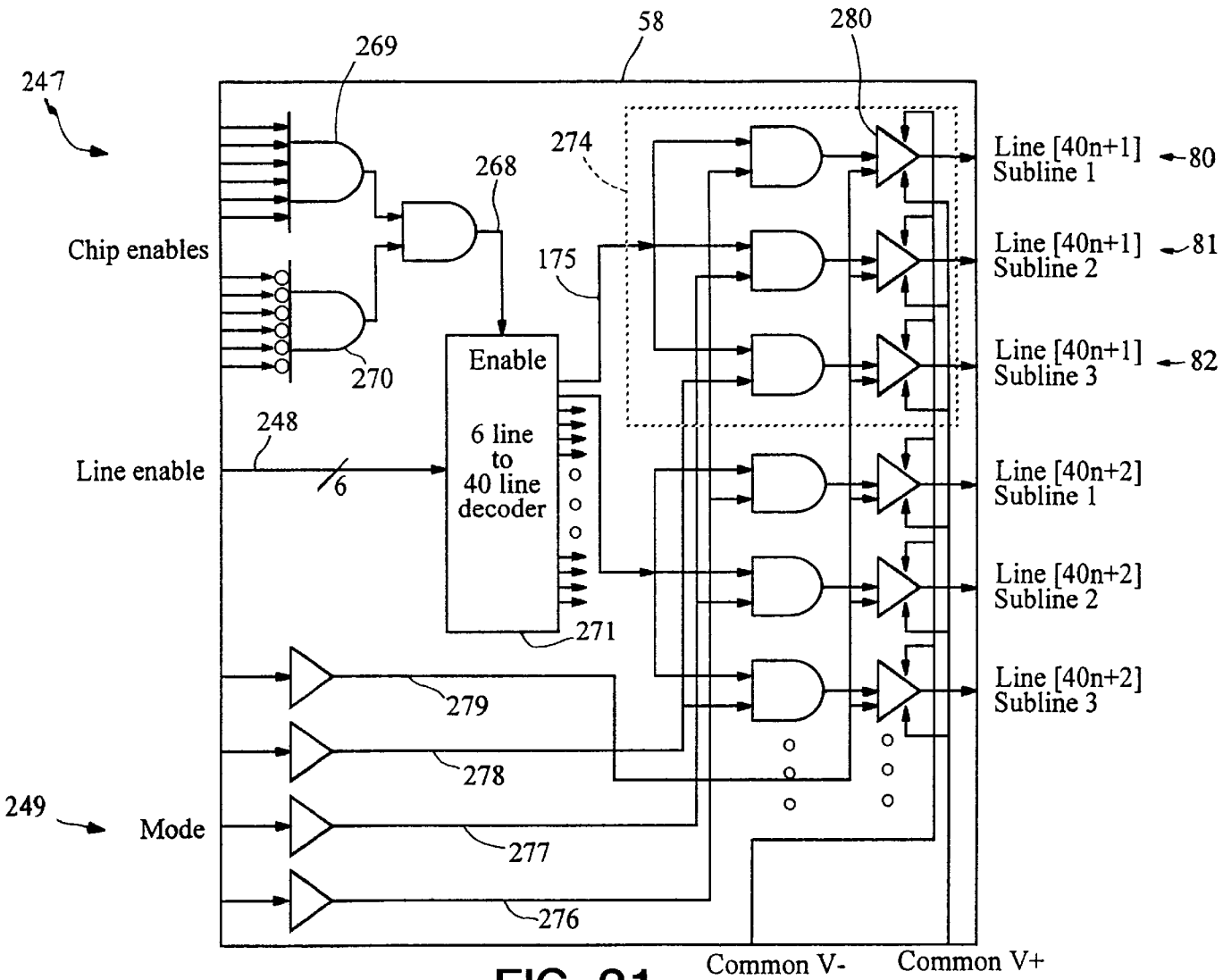
FIG. 21 illustrates a common line driver Tape Automated Bonded (TAB) chip.

Referring now to FIG. 21, there is shown a generic common line driver TAB 58 in more derail. A particular common line driver TAB is chosen by a common line driver enable signal 268, which is derived from the "AWD ing" together of active high 269 and low 270 chip enable signals 247.

Each common line TAB 58 is used to drive 40 lines of pixels, and the line enable signal 248 is decoded by decoder 271 to determine which line of pixels is to be activated. For the purposes of the present discussion, it will be assumed that the first line in the group of 40 lines controlled by the common line TAB 58 is selected 273 by the decoder 271.

The mode of driving the selected line of pixels is controlled by mode signal input 249 in conjunction with drive line control circuitry 274. A top mode line signal 276 is used to control the activation of top common line of a line of pixels 80. A middle mode line 277 is used to control activation of the middle common line 81, and a bottom mode line 278 is used to control the bottom common line 82. Additionally, a common line driver activation signal 279 is used to drive each output common line driver 280 to activate the driving of the common line selected.

Referring back to FIG. 19, as discussed previously, panel controller 53 is responsible for forwarding odd pixel data to odd pixel data drivers 57, and even pixel data to even pixel drivers 59. Each pixel driver e.g. 57, latches the pixel data from its pixel data bus 245, under control of the pixel clock signal 255. As the odd pixel driver TABs 57 control the odd pixels, with each of the 2000/2 odd pixels having 5 drive lines, the number of odd pixel driver lines will be:

2,000×5/2=5,000 pixel drive lines and as each data line drive TAB 57 is designed to drive a 120 display drive line, the number of odd data line drive TABs 57 will be:

5,000/120=42

Similarly, the number of even pixel driver TABs 59 will also be 42.

Figure 22:
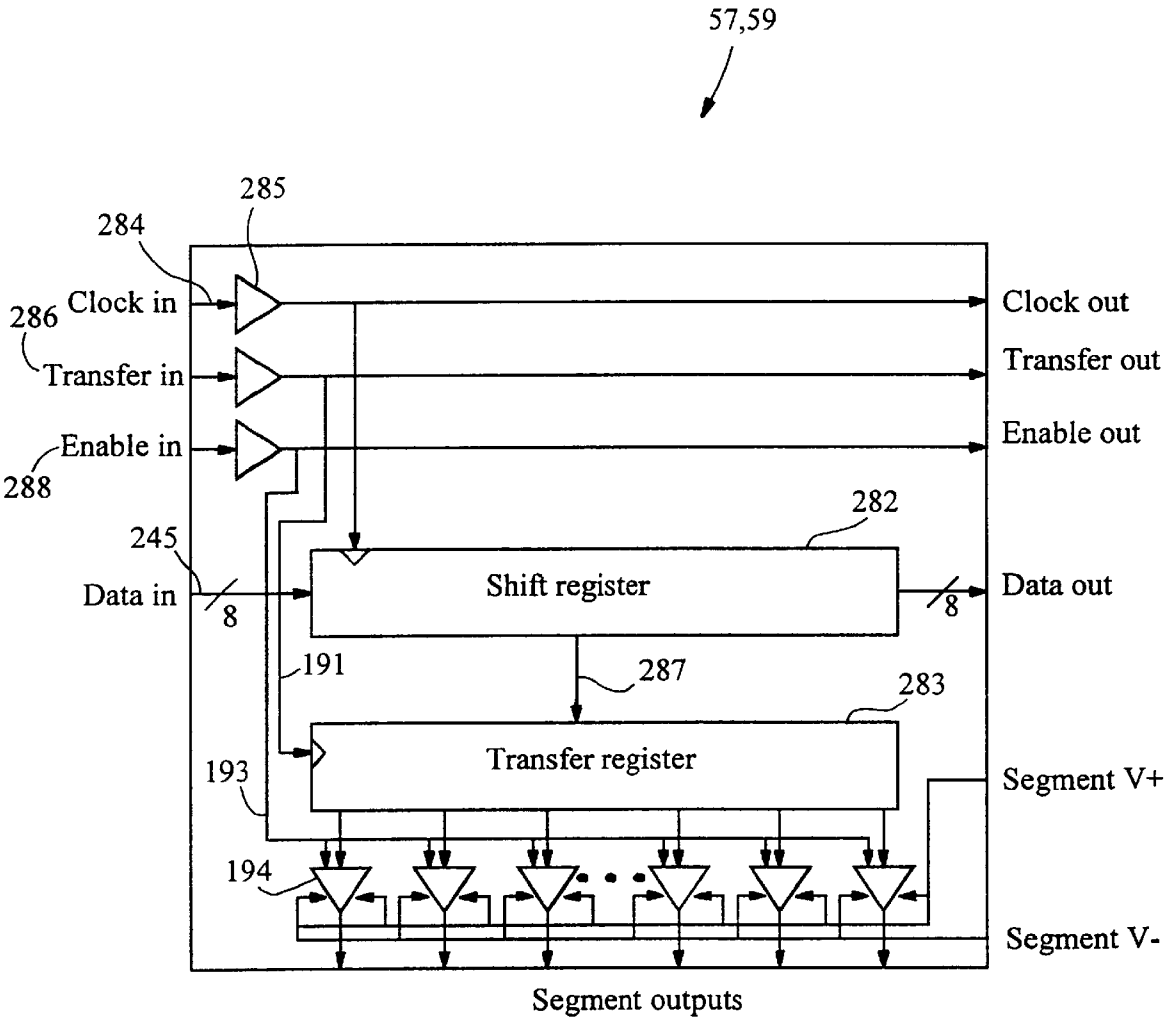
FIG. 22 illustrates a driver TAB chip of FIG. 7.

In FIG. 22, there is shown a data line driver TAB e.g. 57, 59 which includes a shift register 282 and transfer latch 283. Data is shifted from one pixel driver TAB to the next on pixel data bus 245 upon the occurrence of pixel clock signal 284.

Clock regeneration circuit 285 acts to delay the clock signal simultaneously with the delay time of shift register 282. The rate of the clock signal is approximately 9.5 MHz. the actual speed being dependent on the desired line update rate of the display.

After a predetermined number of clock cycles, and when all data has been shifted to its correct position for display, a pixel transfer signal 286 is activated by timing control and state machine 253 (FIG. 20). This results in the transfer of the information 287 stored in the shift register 282 to the transfer register 283.

Finally, an enable signal 288 is sent by timing control state machine 253, thereby enabling display line drivers to drive the output of the display simultaneously with the activation of the even pixel drive lines and the even pixel drivers 55 and the required pixel common line driver TAB 59.

Figure 23:
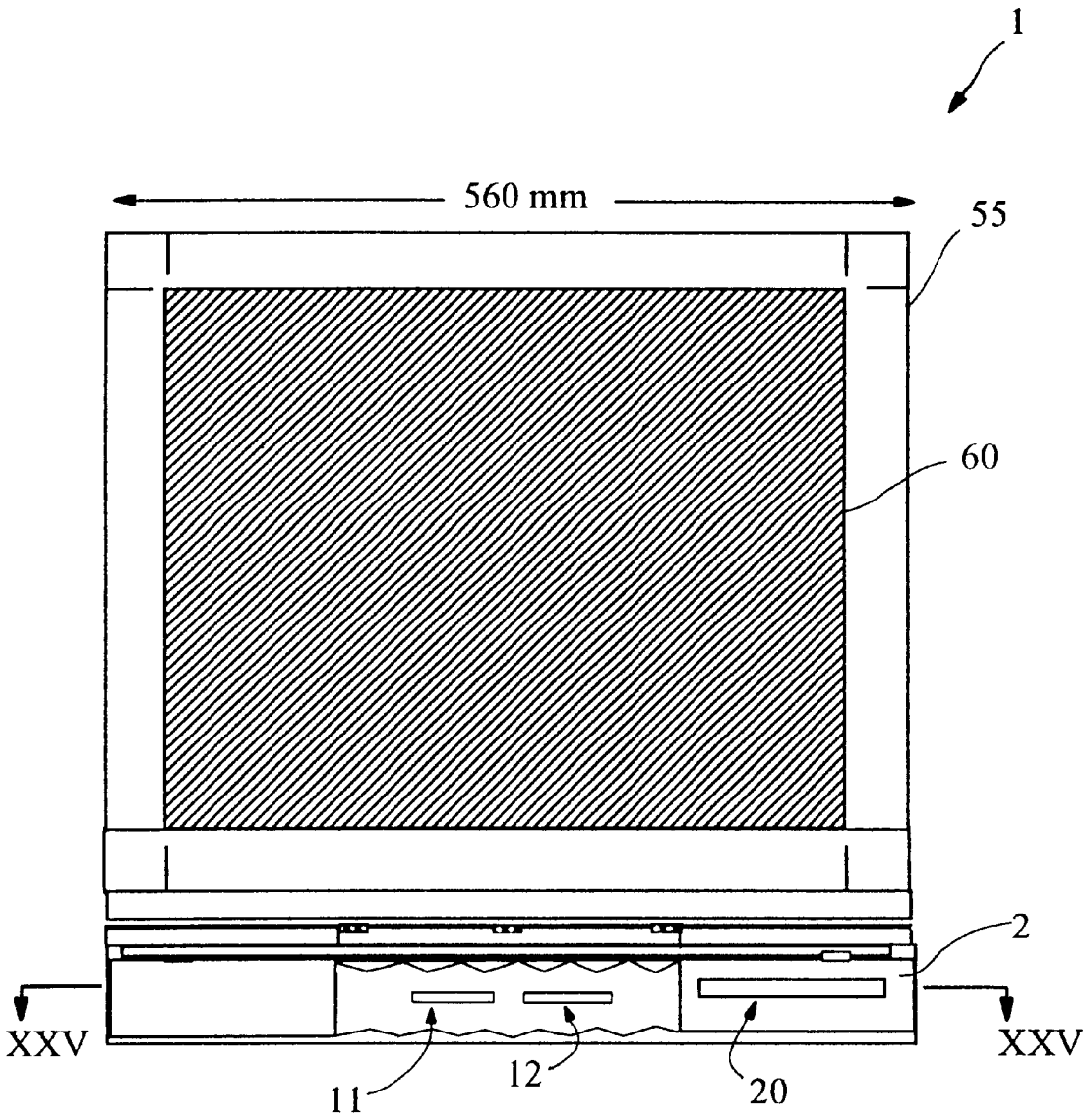
FIG. 23 is a front perspective view of a computer workstation display system incorporating the preferred embodiment.
Figure 24:
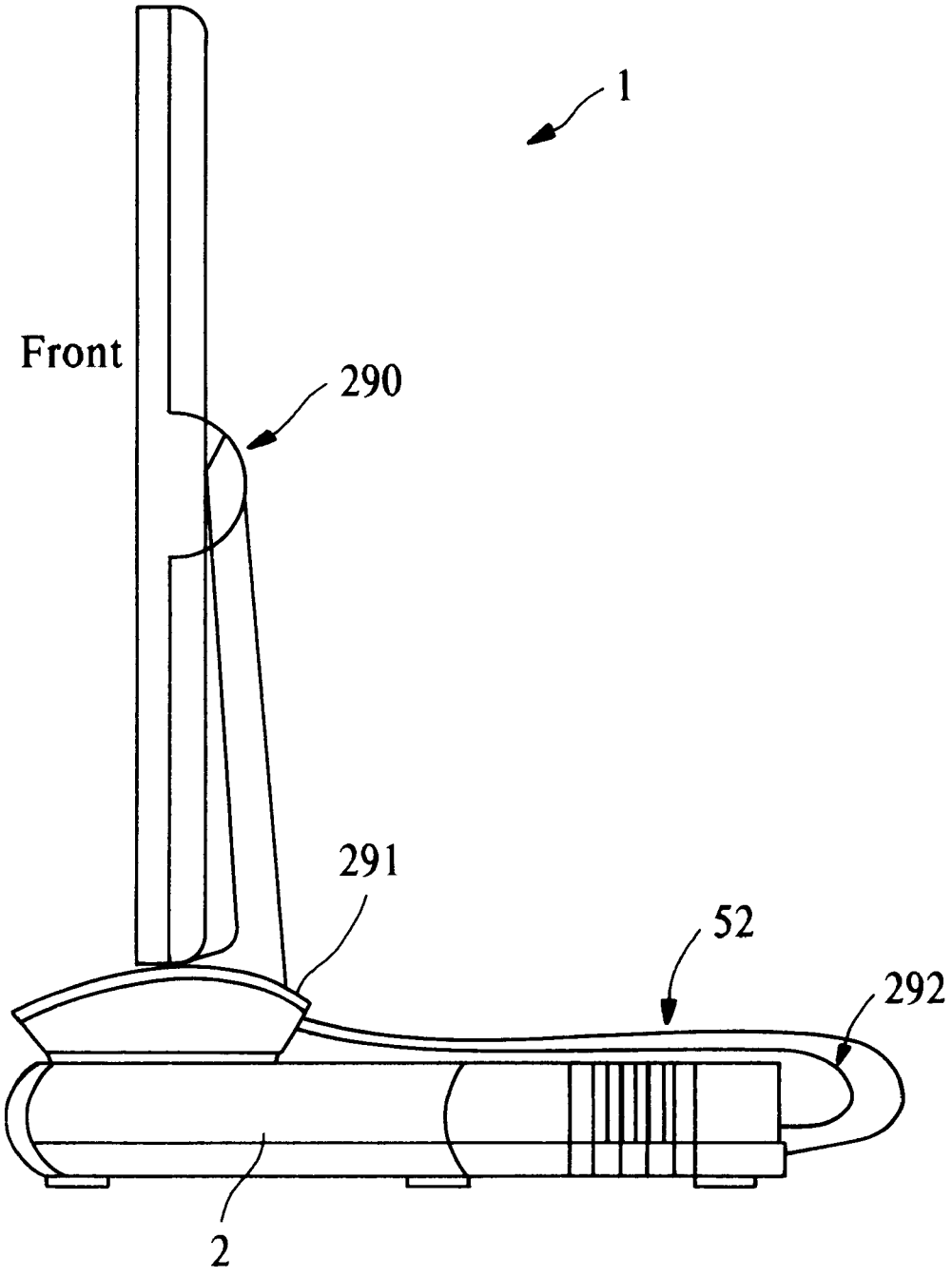

FIGS. 23 and 24, show a final form of the workstation display 1, with FIG. 23 showing a front view and FIG. 24 showing a side on view. The final workstation display 1 which includes the panel system unit containing a display 60 mounted by means of tilt joint 290 and a support base 291 which is in turn mounted on a base computer 2. The display 60 is connected to the base computer 2 by an interface cable 52 and a power cable 292. The support base 291 is designed to cam, the variable voltage power supply 213.

Figure 25:
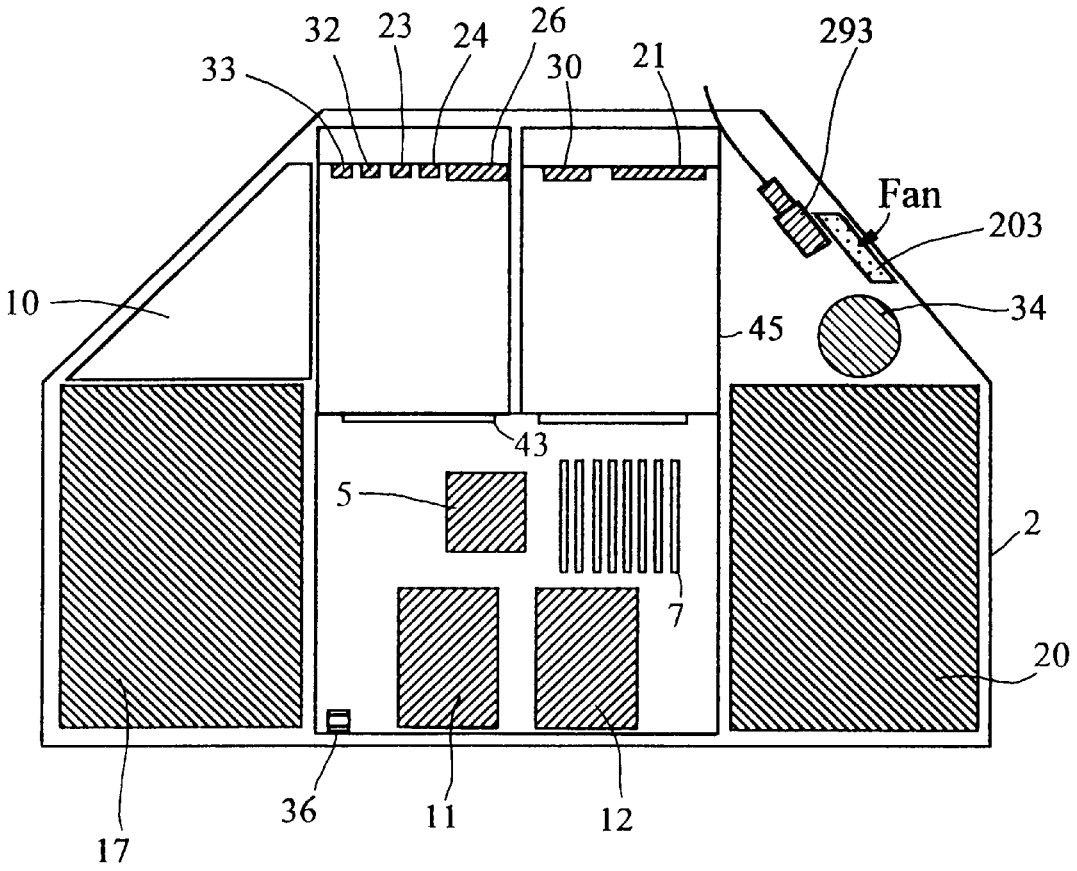
FIG. 25 is a cross-sectional of the computer work station display taken through the line XIV—XIV of FIG. 23.

FIG. 25 shows the interior of the base computer unit 2 via a cross-section taken through the line XXV—XXV of FIG. 23. As discussed previously, the base computer unit 2 includes a hard disk drive 17, a keyboard connector 36, memory card readers 11, 12, a CD-ROM drive 20, a microprocessor 5, memory storage 7, a power supply 10, a general expansion unit 43, a display interface unit 43, a speaker 34, and cooling fan 294. In addition, a number of input/output ports including a power connection 293, a SCSI port 21, ethernet connectors 26, 30, serial A and B connectors 23, 24 and left and right audio channels 32 33 are also provided.

The foregoing describes only one embodiment of the present invention. Modifications obvious to those skilled in the art, can be made thereto without departing from the scope of the invention.

What I claim is:

1. A computer work station comprising:

a computation and data manipulation unit including means for the creation and manipulation of color images, said computation and data manipulation unit being connected to a frame buffering means and being adapted to store images in said frame buffering means;

said frame buffering means comprising a frame buffer storage means for the storage of images and a frame buffer controller means connected to said computation and data manipulation unit and also connected to a high resolution discrete level display device;

said high resolution discrete level display device including a plurality of color pixels which are arranged in an array of substantially parallel display lines, with each color pixel having a plurality of common drive lines and a plurality of data drive lines, and each color pixel being individually settable to a plurality of different states through the intersection of said data drive lines and said common drive lines, wherein said plurality of common drive lines of a line of pixels is capable of being driven in a number of different modes;

wherein images created or manipulated by said computation and data manipulation unit which are to be displayed on said high resolution discrete level display device are stored in said frame buffer and subsequently displayed on said high resolution display device;

means for detecting how many display lines require updating by monitoring display line data as it is read from said frame buffer; and means for updating said display lines in a faster mode when the number of lines to be updated exceeds a predetermined threshold number, wherein said faster mode comprises driving a predetermined number of said common drive lines of each color pixel simultaneously, and wherein said common drive lines of each color pixel are driven independently from one another in another mode.

2. A computer work station as claimed in claim 1, wherein said frame buffering means includes means for determining a driving mode for said line of color pixels.

3. A computer work station as claimed in claim 2, wherein each color pixel has three common drive lines.

4. A computer work station as claimed in claim 1 wherein said frame buffer controller means includes a region fill engine adapted to fill regions of said frame buffer with colour information, said regions being defined by addresses generated by said computation and data manipulation unit.

5. A computer work station as claimed in claim 1 wherein said frame buffer controller means includes an image fill engine adapted to fill regions of said frame buffer with image information, said regions being defined by addresses generated by said computation and data manipulation unit.

6. A computer work station as claimed in claim 1 wherein said frame buffer controller means includes a fine line drawing means adapted to draw lines in said frame buffer from a first point to a second point, said points being generated by said computation and manipulation unit.

7. A computer work station as claimed in claim 1 wherein said frame buffer stores dithered image data.

8. A computer work station as claimed in claim 7 wherein said frame buffer controller means dithers said image data before storing said dithered image data in said frame buffer.

9. A computer work station as claimed in claim 7 wherein said frame buffer controller means further includes means for further dithering said dithered image data before forwarding it to said high resolution discrete level display device.

10. A computer work station as claimed in claim 1, wherein said high resolution discrete level display device further includes a panel controller means connected to said frame buffer controller means and said frame buffer controller reads current line display information from said frame buffer and forms current line display data packets containing line location data, line pixel data and display mode driving information, said mode information determining which of said plurality of common lines of each said color pixel are to be simultaneously driven to display said line pixel data.

11. A computer Fork station as claimed in claim 1 wherein said high resolution discrete level display device further comprises odd and even pixel data drivers for the driving of odd and even pixel data of a line of pixels of the display; and a data distribution unit connected to said frame buffering means and to said odd and even pixel data drivers to receive pixel data from said frame buffering means and to distribute odd pixel data to said odd pixel data driver and even pixel data to said even pixel data driver.

12. A computer workstation as claimed in claim 1 wherein said display device has a memory characteristic and said frame buffer controller means further comprises:

frame buffer input means for inputting display update information to a frame buffer in which said image is stored;

line update detection means connected with said input means for detecting those lines of said image on which said update information occurs; and update controller means, connected to said frame buffer to receive line data therefrom and connected to said line update detection means to receive update line identification data therefrom and adapted to update only said those lines of said displayed image on said discrete level display with said line data of said those lines.

13. A computer work station as claimed in claim 12 wherein said update controller means from time to time refreshes other lines on which no update information has been detected.

14. A computer work station as claimed in claim 12 wherein said faster mode includes dithering of said update display information.

15. A computer work station as claimed in claim 12 wherein said update controller means includes common line determination means for determining whether the information to be displayed by a combination of said common lines is the same.

16. A computer work station means as claimed in claim 15 wherein said update controller means includes combination drive means for driving said combination of said common lines simultaneously when said common line determination means detects said same combination.

17. A computer work station as claimed in claim 12 wherein said common line determination means determines if all the common lines are to display the same information.

18. A computer work station as claimed in claim 12 wherein said frame store input means includes dither value determination means for determining dither values for storing in said frame buffer.

19. A computer work station as claimed in claim 1, wherein said color pixels comprises a plurality of independently alterable luminance areas, and said frame buffer includes storage portions corresponding to the current state of each independently alterable luminance areas.

20. A computer work station as claimed in claim 1 wherein said frame buffer input means includes direct value transfer means for storing in said frame buffer said storage portions.

21. A computer work station as claimed in claim 1, wherein said display device includes a multiplicity of color pixels arranged on lines, each color pixel being individually settable to a plurality of different states through the intersection of data drive lines and common drive lines, with each line of pixels having a number of common lines, and said display device further comprising a panel display controller comprising:

display packet input means adapted to receive inputted line pixel data packets from said frame buffer means comprising pixel data for a line of pixels, line location data for determination of a currently active line of said display, and mode data information for determination of the mode in which to drive said currently active line of said display;

a plurality of pixel display data line drivers, connected to said display packet input means, said pixel display data line drivers receiving said pixel data from said input means and forwarding said pixel data to corresponding data drive lines for the setting of each pixel on a line;

common line driver decoder means connected to said display packet input means to decode a corresponding active common line driver and a corresponding active common line from said line location data and to activate one of a plurality of common line driver means; and a plurality of common line driver means connected to said input means and to said common line driver decoder means, each of said common line driver means, upon activation from said common line driver decoder means driving one of a number of lines of pixels, wherein said mode data information determines if some or all of said common lines are driven independently or simultaneously.

22. A computer work station as claimed in claim 21, wherein said pixel data occurs before said mode data in said line pixel data packet.

23. A computer work station as claimed in claim 21, wherein said line pixel data packet further includes synchronisation data and said display packet input means includes synchronisation data detection means for detection of said synchronisation data and synchronisation of the reception of said inputted line pixel data packet.

24. A computer work station as claimed in claim 23 wherein said inputted line pixel data packets can be decomposed into a plurality of data units and said synchronisation data includes a unique data unit.

25. A computer work station as claimed in claim 240 wherein said synchronisation data comprises the repetition of the same said unique data unit.

26. A display device comprising a display having a plurality of pixels and driver means for driving said display, wherein each of said plurality of pixels has a plurality of common drive lines, wherein said driver means includes a common driver being capable of driving at least two common drive lines of said plurality of common drive lines in each pixel independently from each other and wherein said plurality of common drive lines are driven simultaneously when the number of lines to be updated exceeds a predetermined threshold number, each pixel being individually settable to a plurality of different states through the intersection of data drive lines and said common drive lines, wherein said plurality of common drive lines of a line of pixels is capable of being driven in a number of different modes.

27. A display device according to claim 26, wherein each of said plurality of pixels has three common drive lines, wherein said three common drive lines are driven simultaneously in said certain mode and wherein, in a second mode, two of said three common drive lines are driven simultaneously while the common drive line other than said two common drive lines is driven independently from said two common drive lines.

28. A display device according to claim 27, wherein the number of gradation levels being able to be displayed in said second mode is larger than the number of gradation levels being able to be displayed in said certain mode.

29. A display device according to claim 28, wherein the number of gradation levels being able to be displayed in said second mode is 16 and the number of gradation levels being able to be displayed in said certain mode is 4.

30. A display device according to claim 26, wherein each of said plurality of pixels has three common drive lines, wherein said three common drive lines are driven simultaneously in said certain mode and wherein said three common drive lines are driven independently from one another in a second mode.

31. A display device according to claim 30, wherein the number of gradation levels being able to be displayed in said second mode is smaller than the number of gradation levels being able to be displayed in said certain mode.

32. A display device according to claim 31, wherein the number of gradation levels in said second mode is 2 and the number of gradation levels being able to be displayed in said certain modes is 4.

33. A display device according to claim 26, wherein each of said plurality of pixels has three common drive lines, wherein said three common drive lines are driven simultaneously in said certain mode, wherein two of said three common drive lines are driven simultaneously while the common drive line other than said two common drive lines is driven independently from said two common drive lines in a second mode and wherein said three common drive lines are driven independently from one another in a third mode.

34. A display device according to claim 33, wherein the numbers of gradation levels being able to be displayed in said certain, second and third modes are different from one another.

35. A display device according to claim 34, wherein the number of gradation levels being able to be displayed in said certain mode is 4, the number of gradation levels being able to be displayed in said second mode is 16 and the number of gradation levels in said third mode is 2.

36. A display device according to claim 26, wherein each of said plurality of pixels has three common drive lines, wherein two of said three common drive lines are driven simultaneously while the common drive lines other than said two common drive lines are driven independently from said two common drive lines and wherein, in a second mode, said three common drive lines are driven independently from one another.

37. A display device according to claim 36, wherein the number of gradation levels being able to be displayed in said certain mode is larger than the number of gradation levels being able to be displayed in said a second mode.

38. A display device according to claim 37, wherein the number of gradation levels being able to be displayed in said certain mode is 16 and the number of gradation levels being able to be displayed in said second mode is 2.

39. A display device according to claim 26, wherein each of said plurality of pixels has a plurality of data drive lines, each of said plurality of data drive lines being able to be driven independently, and wherein said certain mode is selected when the same data is consecutively inputted in the data drive line.

40. A display device according to claim 26, wherein each of said plurality of pixels includes a plurality of sub-pixels being different from one another in area and wherein at best two of said plurality of sub-pixels are situated on the same common drive line while at least another two of said plurality of sub-pixels are situated on the common drive line other than said common drive line.

41. A display device according to claim 26, wherein each of said plurality of pixels has three common drive lines, wherein said three common drive lines are driven simultaneously in said certain mode and wherein, in another mode, two of said three common drive lines which are not adjacent to each other are driven simultaneously while the remaining common drive line being situated between said two common drive lines is driven independently from said two common drive lines.

42. A display device according to claim 26, wherein each of said plurality of pixels has three common drive lines, wherein said three common drive lines are driven simultaneously in said certain mode and wherein, in another mode, two of said three common drive lines corresponding to two sub-pixels which are not adjacent to each other are driven simultaneously while the remaining common drive line corresponding to another sub-pixel being situated between said hero sub-pixels is driven independently from said two common drive lines.

43. A display device according to claim 26, wherein each of said plurality of pixels is either a red pixel, a green pixel or a blue pixel and wherein said display is able to perform color display.

44. A display device according to claim 26, wherein said certain mode is selected when the number of lines of which data is updated becomes larger than a predetermined number.

45. A computer work station comprising:

a computation and data manipulation unit including means for the creation and manipulation of images, said computation and data manipulation unit being connected to a frame buffering means and being adapted to store images in said frame buffering means;

said frame buffering means comprising a frame buffer storage means for the storage of images and a frame buffer controller means connected to said computation and data manipulation unit and also connected to a high resolution discrete level display device;

said high resolution discrete level display device including a plurality of pixels which are arranged in an array of substantially parallel display lines, with each pixel in a line having a plurality of common drive lines;

wherein images created or manipulated by said computation and data manipulation unit which are to be displayed on said high resolution discrete level display device are stored in said frame buffer and subsequently displayed on said high resolution display device;

means for detecting how many display lines require updating by monitoring display line data as it is read from said frame buffer; and means for updating said display lines in a faster mode when the number of lines to be updated exceeds a predetermined threshold number, wherein said faster mode comprises driving a predetermined number of said common drive lines of each color pixel simultaneously, and wherein said common drive lines of each color pixel are driven independently, wherein each pixel is individually settable to a plurality of different states through the intersection of dam drive lines and common drive lines, with each line of pixels having a number of common lines, and said display device further comprising a panel display controller comprising:

display packet input means adapted to receive inputted line pixel data packets from said frame buffer means comprising pixel data for a line of pixels, line location data for determination of a currently active line of said display, and mode data information for determination of the mode in which to drive said currently active line of said display, a plurality of pixel display data line drivers, connected to said display packet input means, said pixel display data line drivers receiving said pixel data from said input means and forwarding said pixel data to corresponding data drive lines for the setting of each pixel on a line;

common line driver decoder means connected to said display packet input means to decode a corresponding active common line driver and a corresponding active common line from said line location data and to activate one of a plurality of common line driver means; and a plurality of common line driver means connected to said input means and to said common line driver decoder means, each of said common line driver means, upon activation from said common line driver decoder means driving one of a number of lines of pixels, wherein said mode data information determines if some or all of said common lines are driven independently or simultaneously.

46. A computer work station as claimed in claim 45, wherein said pixel data occurs before said mode data in said line data packet.

47. A computer work station as claimed in claim 45, wherein said line pixel data packet further includes synchronisation data and said display packet input means includes synchronisation data detection means for detection of said synchronisation data and synchronisation of the reception of said inputted line pixel data packet.

48. A computer work station as claimed in claim 47 wherein said inputted line pixel data packets can be decomposed into a plurality of data units and said synchronisation data includes a unique data unit.

49. A computer work station as claimed in claim 48 wherein said synchronisation data comprises the repetition of the same said unique data units from one another in another mode.

* * * * *

UNITED STATES PATENT AND TRADEMARK OFFICE

CERTIFICATE OF CORRECTION

PATENT NO. : 6,002,385

DATED : December 14, 1999

INVENTOR(S) : KIA SILVERBROOK

It is certified that error appears in the above-identified patent and that said Letters Patent is hereby corrected as shown below:

COLUMN 1:

Line 22, "bulks," should read --bulky,--; and
Line 31, "cam" should read --carry--.

COLUMN 2:

Line 30, "derail;" should read --detail;-- and
Line 66, "RAMBNS" should read --RAMBUS--.

COLUMN 3:

Line 51, "ferro electric" should read --ferroelectric--.

COLUMN 4:

Line 34, "uruson" should read --unison--; and
Line 46, "less" should read --fewer--.

COLUMN 5:

Line 4, "DRANM" should read --DRAM--;
Line 38, "lookup" should read --look up--; and
Line 47, "30" should be deleted.

UNITED STATES PATENT AND TRADEMARK OFFICE

CERTIFICATE OF CORRECTION

PATENT NO. : 6,002,385

DATED : December 14, 1999

INVENTOR(S) : KIA SILVERBROOK

It is certified that error appears in the above-identified patent and that said Letters Patent is hereby corrected as shown below:

COLUMN 7:

Line 34, "involve" should read --involves--;
Line 39, "or" should read --of--; and
Line 58, "leter" should read --letter--.

COLUMN 8:

Line 11, "chose" should read --those--;
Line 39, "results" should read --result--;
Line 61, "eve" should read --eye--; and
Line 63, "decrease." should read --decreases.--.

COLUMN 10:

Line 30, "Is" should read --is--.

COLUMN 12:

Line 5, "non-bin" should read --non-binary--; and
Line 35, "tog" should read --taking--.

COLUMN 13:

Line 2, "co" should read --to--.

UNITED STATES PATENT AND TRADEMARK OFFICE

CERTIFICATE OF CORRECTION

PATENT NO. : 6,002,385

DATED : December 14, 1999

INVENTOR(S) : KIA SILVERBROOK

It is certified that error appears in the above-identified patent and that said Letters Patent is hereby corrected as shown below:

COLUMN 14:

Line 17, "includes." should read --includes:--.

COLUMN 15:

Line 3, "is" (2nd occurrence) should be deleted; and
Line 8, "We" should read --the--.

COLUMN 16:

Line 1, "ore" should read --one--; and
Line 8, "previously.Syn-" should read --previously, syn--

COLUMN 17:

Line 39, "cam," should read --carry--.

COLUMN 19:

Line 38, "drive" should read --driving--;
Line 49, "comprises" should read --comprise--; and
Line 52, "areas." should read --area.--

UNITED STATES PATENT AND TRADEMARK OFFICE

CERTIFICATE OF CORRECTION

PATENT NO. : 6,002,385

DATED : December 14, 1999

INVENTOR(S) : KIA SILVERBROOK

It is certified that error appears in the above-identified patent and that said Letters Patent is hereby corrected as shown below:

COLUMN 20:

Line 36, "240" should --24--.

COLUMN 21:

Line 16, "modes" should read --mode--.

COLUMN 22:

Line 14, "hero" should read --two--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*